US006219871B1

(12) United States Patent
Frederick et al.

(10) Patent No.: US 6,219,871 B1
(45) Date of Patent: Apr. 24, 2001

(54) WASHING APPARATUS AND METHOD UTILIZING FLEXIBLE CONTAINER TO IMPROVE CLEANING EFFICIENCY AND MINIMIZE SPACE OCCUPANCY

(76) Inventors: Max B. Frederick, P.O. Box 668, Arnold, CA (US) 95223; Alberto Guerrero, 1531 Gentry St., Clearwater, FL (US) 34615; Joe T. Maddux, P.O. Box 847, Arnold, CA (US) 95223

( * ) Notice: Subject to any disclaimer, the term of this patent is extended or adjusted under 35 U.S.C. 154(b) by 0 days.

(21) Appl. No.: 08/839,683

(22) Filed: Apr. 14, 1997

(51) Int. Cl.[7] ..... D06B 5/24

(52) U.S. Cl. ..... 8/159; 68/355; 68/242; 68/183; 68/96

(58) Field of Search ..... 8/158, 159; 68/96, 68/242, 355, 183

(56) References Cited

U.S. PATENT DOCUMENTS

| | | | | |
|---|---|---|---|---|
| 1,405,440 | * | 2/1922 | Randall et al. | 68/242 |
| 2,449,634 | | 9/1948 | Baade | 68/12 |
| 2,472,682 | | 6/1949 | Rand | 68/21 |

(List continued on next page.)

FOREIGN PATENT DOCUMENTS

| | | | | |
|---|---|---|---|---|
| 200600 | * | 12/1955 | (AU) | 68/242 |
| 2907562 | * | 8/1980 | (DE) | 68/3 SS |
| 875201 | * | 8/1961 | (GB) | 68/3 SS |
| 223752 | * | 11/1968 | (SU) | 68/96 |
| 1395711 | * | 5/1988 | (SU) | 8/159 |

*Primary Examiner*—Frankie L. Stinson

(57) ABSTRACT

An automatic laundry washing machine that is suitable for use in living units having no area set aside for laundry facilities is achieved by replacing the heavy bulky parts of the currently popular automatic washing machine design with a light flexible bag. A large portion of the volume of any washing machine is the vessel for containing the laundry solution and articles to be washed. That vessel is a flexible bag made of modern durable material so as to be collapsible both while in use and for storage. The method of use includes the complete process of washing, rinsing, and extracting excess water in an automatic cycle analogous to standard automatic washing machines popular today. The vessel containing the items being laundered is a waterproof laundry bag with automatic washing apparatus attached. Items are automatically washed in that bag. The automatic process includes cycles of filling, washing, rinsing and extracting such that the clothes are ready for a drying process such as hanging out to dry or putting into a tumble dryer. The agitating of the washing and rinsing cycles is accomplished without the familiar bulky agitator thereby reducing the volume requirements and the traditional wear and tear on the garments. By eliminating the bulky agitator and the spin water extraction method, the heavy transmission is also eliminated. The water extraction cycle is done in a much less violent way than the conventional spin cycle by allowing atmospheric pressure to collapse the washing vessel and press the water from the articles as the water and air are pumped from the vessel in the draining portion of the cycle. The cleaning ability of the water is enhanced by built in ionic processing of the water thereby reducing the required amount of laundry detergent. The agitating in the non-electrically conductive vessel generates static electric charges in the process and ions thus produced further enhance the cleaning ability of the water. Cavitation produced in a multi-frequency washing action further enhances the washing ability of the water. The washing machine is light, compact and collapsible and is as portable as a piece of luggage. The set up procedure is simple and no assembly is required beyond attaching a quick connect fastener to a water faucet and plugging in a power cord. The washing machine is light and takes little storage space. It can be put in a small closet or on a shelf when not in use. The minimum capacity of the washing machine is a single garment. The normal capacity of the washing machine is comparable to that of a standard household washing machine.

20 Claims, 30 Drawing Sheets

U.S. PATENT DOCUMENTS

| | | | | |
|---|---|---|---|---|
| 2,499,162 | | 2/1950 | Rand | 68/96 |
| 2,596,791 | * | 5/1952 | Rand | 68/242 |
| 2,629,244 | * | 2/1953 | Rand | 68/242 |
| 2,633,726 | * | 4/1953 | Rand | 68/242 |
| 2,636,372 | * | 4/1953 | Rand | 68/12.05 |
| 2,641,916 | * | 6/1953 | Johnson | 68/242 |
| 2,655,803 | * | 10/1953 | Richardson | 8/159 |
| 2,666,315 | * | 1/1954 | Abresch | 68/12.14 |
| 2,676,088 | * | 4/1954 | Bilde et al. | 8/159 |
| 2,737,039 | * | 3/1956 | Wales | 68/242 |
| 2,766,601 | * | 10/1956 | Thiele | 68/242 |
| 2,997,870 | | 8/1961 | Serra | 68/173 |
| 3,178,913 | | 4/1965 | Olson | 68/12 |
| 3,318,117 | | 5/1967 | Padial | 68/21 |
| 3,338,075 | | 8/1967 | Gunji Usami et al. | 68/43 |
| 3,503,085 | | 3/1970 | Groebli | 8/158 |
| 3,516,269 | | 6/1970 | MacKenzie | 68/96 |
| 3,693,382 | | 9/1972 | Grantham | 68/96 |
| 3,771,335 | | 11/1973 | Hall | 68/21 |
| 3,807,201 | | 4/1974 | Gorsuch | 68/23 |
| 4,066,393 | | 1/1978 | Morey et al. | 8/137 |
| 4,164,430 | | 8/1979 | Reinwald et al. | 134/13 |
| 4,305,265 | | 12/1981 | Burgas | 68/122 |
| 4,903,718 | | 2/1990 | Sullivan | 134/184 |
| 5,203,362 | | 4/1993 | Shibata | 134/184 |
| 5,309,739 | | 5/1994 | Lee | 68/3.055 |
| 5,358,617 | | 10/1994 | Ibbott | 204/248 |
| 5,377,838 | | 1/1995 | Segre | 206/527 |
| 5,511,396 | | 4/1996 | Kim et al. | 68/3.055 |
| 5,599,455 | | 2/1997 | Hukai | 210/663 |

* cited by examiner

| Symbol | Definition |
|---|---|
| CD | Control |
| AP | Air Pump |
| WP | Water Pump |
| FD | Flow Diverter |

| Symbol | Definition |
|---|---|
| A | Air Flow |

| Symbol | Definition |
|---|---|
| AP | Air Pressure |

| Symbol | Definition |
|---|---|
| A | Air Flow |
| D | To Drain |
| WF | Water Flow |
| AP | Air Pressure |

| Symbol | Definition |
|---|---|
| WJ | Water to Jets |
| WP | Water from Pump |

WASHING APPARATUS AND METHOD UTILIZING FLEXIBLE CONTAINER TO IMPROVE CLEANING EFFICIENCY AND MINIMIZE SPACE OCCUPANCY

BACKGROUND—FIELD OF THE INVENTION

This invention relates to washing clothes in the home, particularly to an automatic washing machine which operates in a seemingly paradoxical manner and which will automatically wash a full sized load in the home without a requirement for space dedicated to a laundry facility in the home and which, while drastically reducing the size and weight from that of a standard automatic washing machine, increases cleaning efficiency and reduces environmental pollution to a greater extent than heretofore possible.

BACKGROUND—DESCRIPTION OF THE PRIOR ART

Ever since modern machines moved washday activities inside, there has been a long recognized and unfilled need to eliminate the requirement for a dedicated laundry room in living units while still having the capability to wash clothes without making an outside trip and without having to do it by hand.

Another long recognized and unfilled need is the lack of laundry facilities in a living unit such as an apartment or mobile home which does not have a designated laundry area set aside and dedicated to full time occupancy by laundry machines. This need has been recognized as is evidenced by many inventions of compact or portable machines. However, these inventions have such a greatly reduced capacity or increased inconvenience that it has not been commercially accepted as a solution to this problem. Thus, the commercial success of the local Laundromat.

Keeping clothes clean has been a problem since ancient times. Early in the history of this country pioneers washed their clothes by dipping them in the water of the river and rubbing them on rocks near the water. However, a trip outside the home to the local laundry facility was required.

The forerunner of the modern washing machine was a washboard. Using the washboard was somewhat like washing in the river. The user dipped the clothes in a tub of water and rubbed the clothes on the washboard. No longer was a trip to the river necessary. However, the drudgery and dedication of time remained.

The next major break through was the self powered washing machine eliminating the backbreaking work of rubbing the clothes by hand. However, added to the drudgery and dedication of time was the requirement for dedicated space in the home for the washing machine. Suddenly, the useful space in the home became less. The washing machine was always there and in the way.

After that came the automatic washing machine which eliminated the drudgery and the requirement of getting hands wet. However, the dedicated space requirement taking living space from the home remained a problem.

Not all homes have the luxury of extra space to dedicate to a washing machine. Even still, the residents of many homes that have no laundry facilities make the periodic outside trip to the public Laundromat. Still remaining is that long recognized and unfilled need, the need for full sized automatic laundry capability in the home without the requirement of space dedicated to laundry machines.

When people used the river for a Laundromat, wringing out the water was simply a matter of manually applying twisting pressure with the hands. However, that was manual labor.

With the early washing machine came the powered wringer, a device with rollers pressed against the clothes to squeeze the water from the clothes. However, still a human was required to feed each piece into the rollers, sometimes with much pain when long hair would get in with the clothes.

Automatic washing machines came with the advent of water extraction by centrifugal force in a spinning tub. No longer was it necessary to manually remove the clothes from the tub to remove the water from the clothes. The clothes rather than the water remained in the tub throughout the automatic cycle with the water coming and going in the same tub. The disadvantage of the centrifugal extraction machine is the requirement for a perforated washing and spinning tub inside a water containing tub. This results in two heavy metal tubs in addition to the heavy enclosure made of rigid metal surrounding all the other parts results in a big heavy machine that requires a permanent location. With the advent of centrifugal extraction the rollers were removed from the legs of the washing machine. Homemakers have been sharing their homes with the washing machine ever since. Other wringing methods were tried, but did not become popular. This loss of living space in the home has been the standard for decades.

Further, most clothes washing machines are inefficient energy wasters and environment polluters that wash the laundry by utilizing the mechanical force of an agitator and the surface active force of a chemical detergent. Accordingly, in order to improve the washing efficiency, many clothes washing machine makers have utilized various methods including such as improving the agitators ability to agitate the laundry, extending the operating time of the motor during a washing and/or rinsing time period and improving the quality and/or increasing the quantity of detergent used in the washing machine. However, there are limits to improvements in the washing efficiency by the aforementioned methods for the following reasons:

(a) The methods utilizing increased mechanical force to improve the washing efficiency may cause damage to the laundry or to efficiency of the clothes washing machine.

(b) In methods utilizing increased amounts of detergent, a relatively large amount of the detergent which does not react with the laundry is then discharged where it can later cause environmental pollution, and also the remaining detergent sticks to the laundry and thus the laundry is not effectively cleaned.

(c) Also, it is well known that if more than the recommended amount of detergent is used in the clothes washing machine, the washing efficiency of the washing machine is reduced.

Accordingly, inventors created several types of devices to generate surface tension reducing ions for the purpose of reducing the amount of detergent required:

U.S. Pat. No. 5,309,739 to Lee (1994) discloses a device which utilizes the generation of surface-tension-reducing hydroxyl ions for the purpose of reducing the amount of detergent required. However, this device is an add on to the standard automatic washing machine described above.

U.S. Pat. No. 4,066,393 to Morey and Dooley (1978) discloses a device which utilizes a cation exchange resin device to remove calcium and/or magnesium ions from the water for the purpose of reducing the amount of detergent required. However, this device requires a manual step in the washing process and it too is an add on to the standard automatic washing machine described above.

U.S. Pat. No. 5,358,617 to Ibbott (1994) discloses a water treatment devise to use in a standard automatic washing machine which utilizes electrically isolated electrodes of different electrochemical potential to ionize the wash water inside the washing machine for the purpose of reducing the amount of detergent required to little or none depending upon the amount of dissolved solids in the wash water. However, this device requires a standard automatic washing machine described above.

U.S. Pat. No. 2,997,870 to Serra (1961) discloses a washing machine which utilizes friction due to the motion of air, water, and an India rubber vessel in an electrostatic ionic process for the purpose of reducing the amount of detergent required. However, this washing machine is not automatic. It is an attempt to solve the problem of storage out of the way when not in use and has traded off the automatic feature for a more manual system with reduced capacity.

In the prior art there are many patents on collapsible, foldable, portable washing machines with an object to satisfy that long recognized and unfilled need to eliminate the requirement for a dedicated laundry room in living units:

U.S. Patent No. 4,305,265 to Burgas (1981) discloses a washing machine that is to be disassembled when not in use. However, it is not automatic, but hand powered, and complicated to set up.

Other examples of washing machine patents that purport to be space saving are too numerous to mention. Generally they suffer with some or all of the disadvantages of reduced capacity, manually powered, non-automatic, complicated, or inefficient. As a general rule, to make a washing machine lighter, collapsible, foldable, or portable, there is a trade off resulting in inefficiency, and reduced capacity.

The popular automatic washing machines of today are in the way all the time even when not used:

(a) They cannot be stored out of the way.

(b) They cannot be folded into a small space (c) They cannot be moved or carried around easily.

(d) They are not easily transportable.

The popular automatic washing machines of today contribute significantly to environmental pollution and waste:

(a) Excess, inefficient detergent use contributes to chemical pollution.

(b) Excess energy use wastes our natural resources.

(c) Excess noise disrupts our daily life.

(d) Mechanical agitator causes excess wear and tear on clothing.

OBJECTS AND ADVANTAGES

Accordingly, several objects and advantages of the present invention are:

(a) to provide an automatic washing machine which fills that long recognized and unfilled need for full sized automatic laundry capability in the home without the requirement for dedicated space;

(b) to provide an automatic washing machine which is suitable for use in living units having no area set aside for laundry facilities, such as apartments or mobile homes;

(c) to provide an automatic washing machine which is out of the way when not in use, yet has sufficient capability and convenience such that it will actually be used;

(d) to minimize the drudgery and dedication of time required for hand washing and outside trips to the Laundromat;

(e) to provide an automatic washing machine which will allow the user to reclaim that living space in the home occupied by the washing machine when it is not in use;

(f) to provide an automatic washing machine which painlessly extracts the water from the clothing in a quiet manner without human interaction, without shaking the house, and without the requirement for a large heavy machine;

(g) to provide an automatic washing machine which makes efficient use of energy by eliminating heavy bulky parts which require energy to move;

(h) to provide an automatic washing machine which is gentle to the clothes and reduces the wear and tear of the clothes being washed;

(i) to provide an automatic washing machine which protects our environment from pollution by making efficient use of a minimal amount of detergent;

(j) to provide an automatic washing machine which eliminates the problem of detergent residue in the clean laundry;

(k) to provide an automatic washing machine which utilizes non-polluting ionic methods to increase the cleaning properties of water by reducing the surface tension of water, and does not require a large bulky machine;

Accordingly, the above objects and advantages are to provide an automatic washing machine which can be folded into a small space, which can be easily moved or carried around, which can be stored out of the way, which can be carried as a piece of luggage, which eliminates the excess noise which disrupts our lives, which will conserve rather than waste and pollute our natural resources to a greater extent than heretofore possible.

A further object of the present invention is to provide a unique means for scrubbing laundry employing a cleaning action and a combination of cleaning actions which eliminates the need for many of the heavy bulky parts of a machine of the prior art. The combination provides a superior process of washing without abrasion damage.

A further object of the present invention is to provide a unique means for extracting water from laundry employing a vacuum extraction action in combination with alightweight flexible container which presses the water from the laundry and eliminates the need for many of the heavy bulky parts of a machine of the prior art.

The aforementioned objects and advantages of the invention, will, in part, become obvious from the following more detailed description of the invention, taken in conjunction with the accompanying drawings, which form an integral part thereof.

DRAWING FIGURES

The present invention will be more fully understood by reference to the following detailed description thereof when read in conjunction with the attached drawings, and wherein.

Figure 3A:
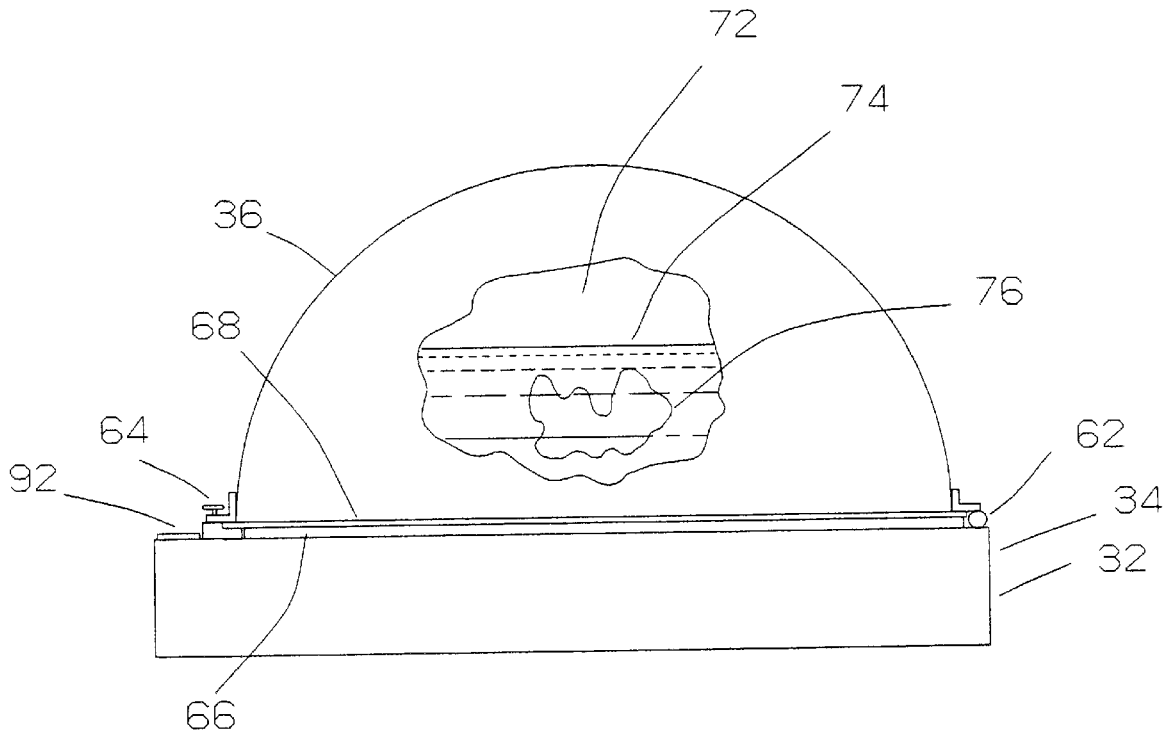
Figure 3B:
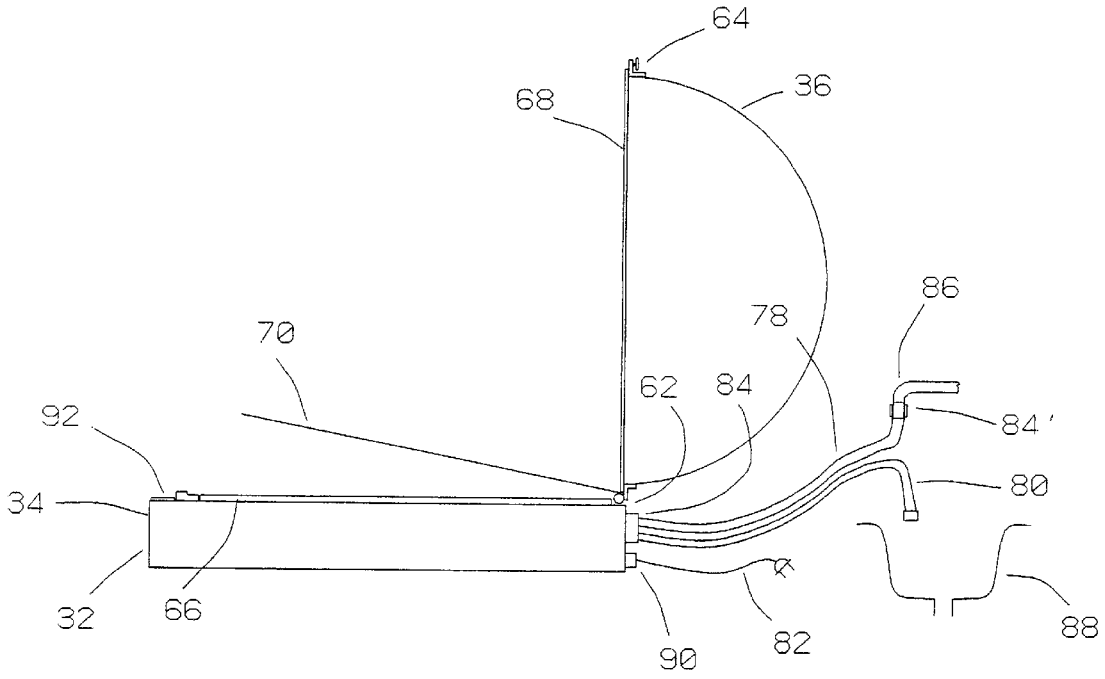
Figure 4A:
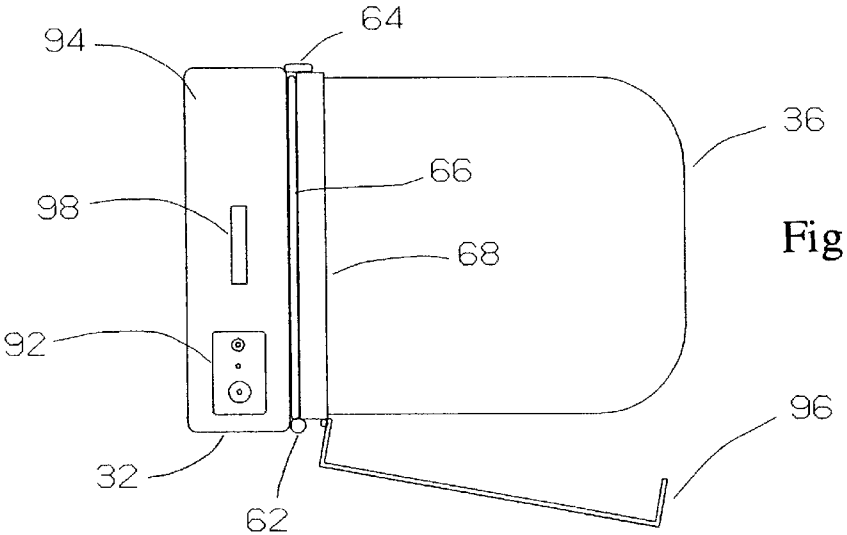
Figure 4C:
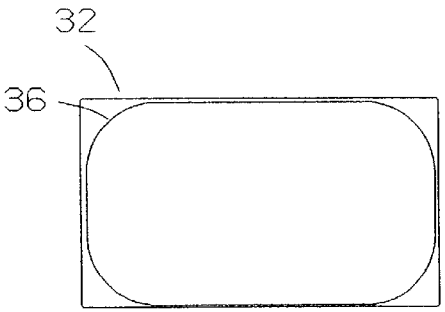
Figure 4B:
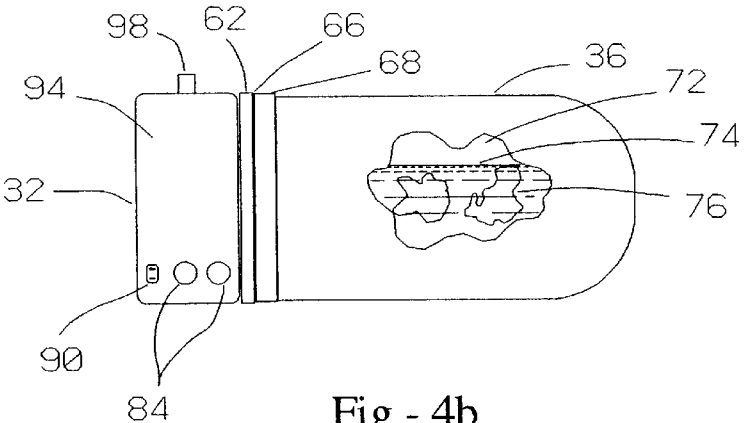
Figure 5A:
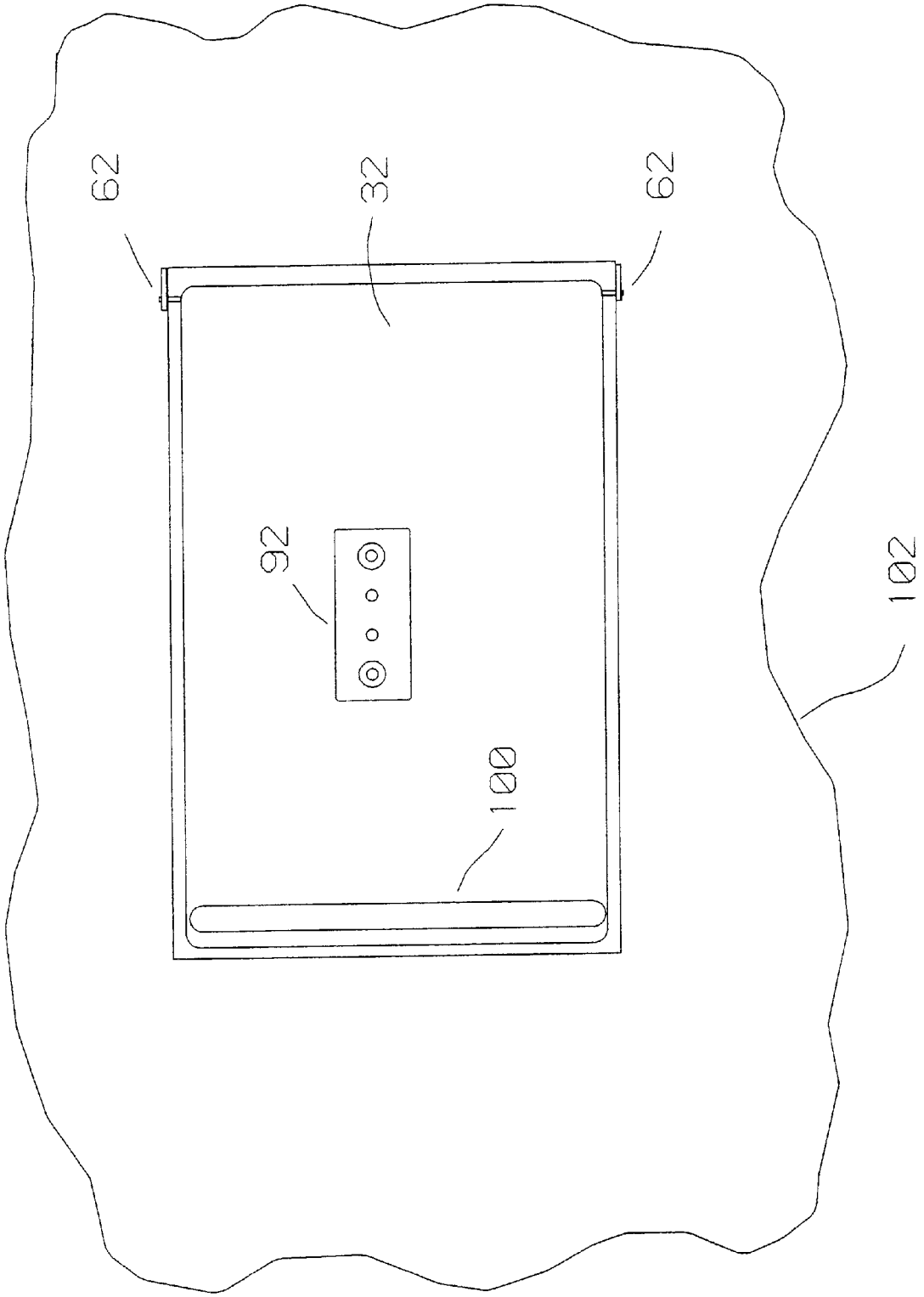
Figure 5B:
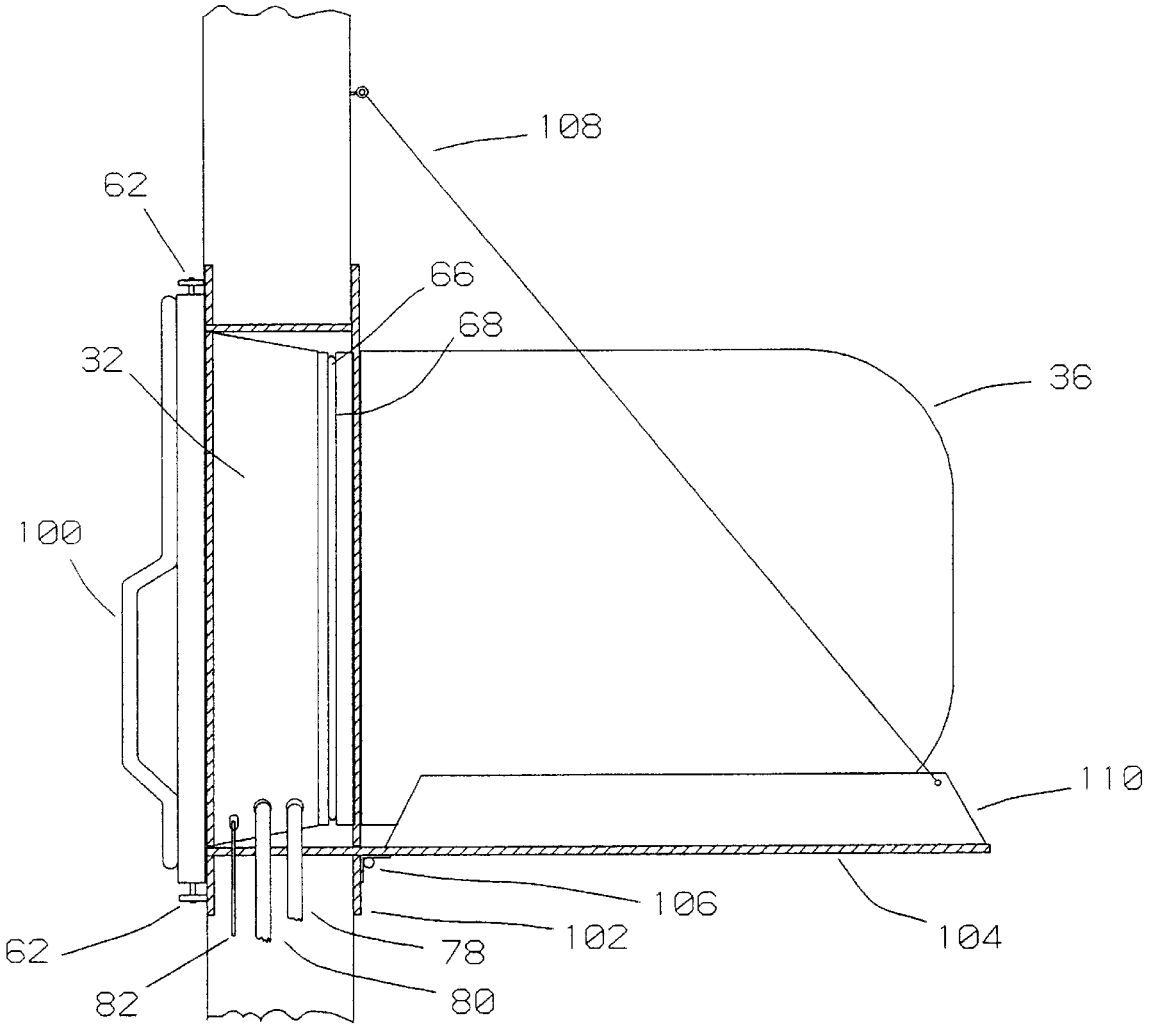
Figure 5C:
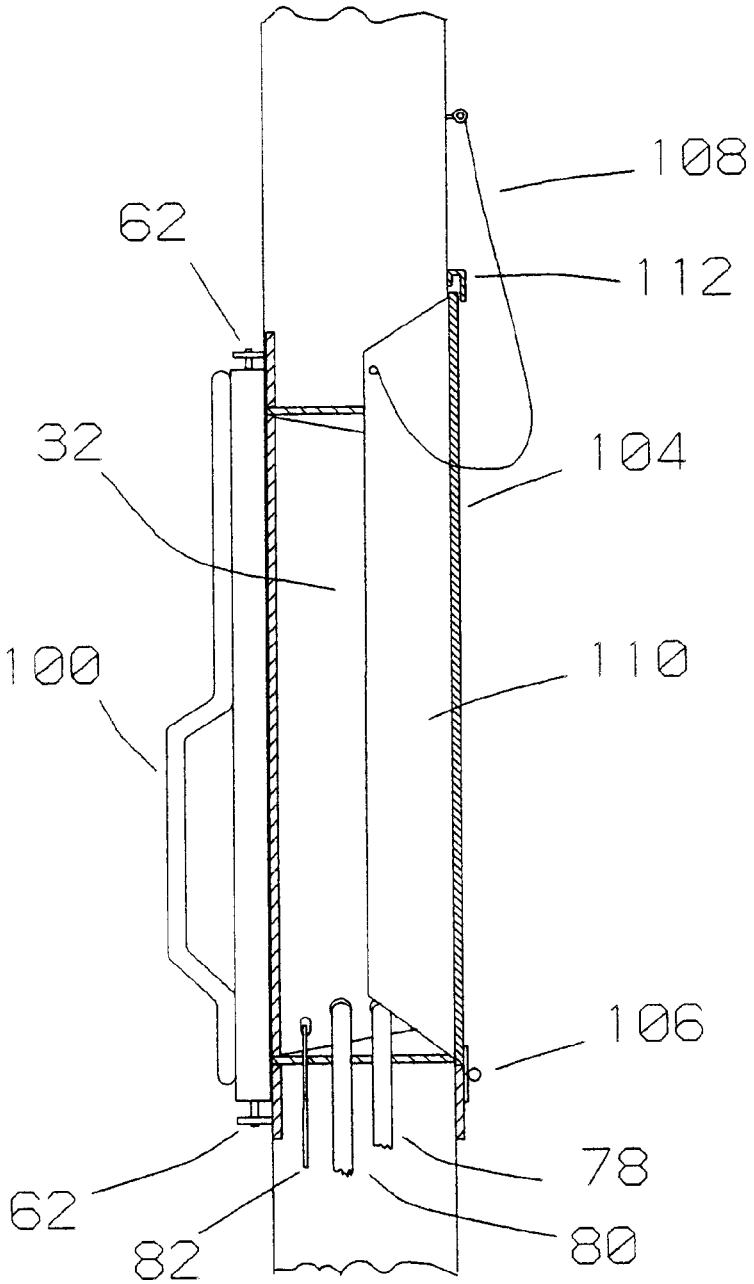
Figure 8:
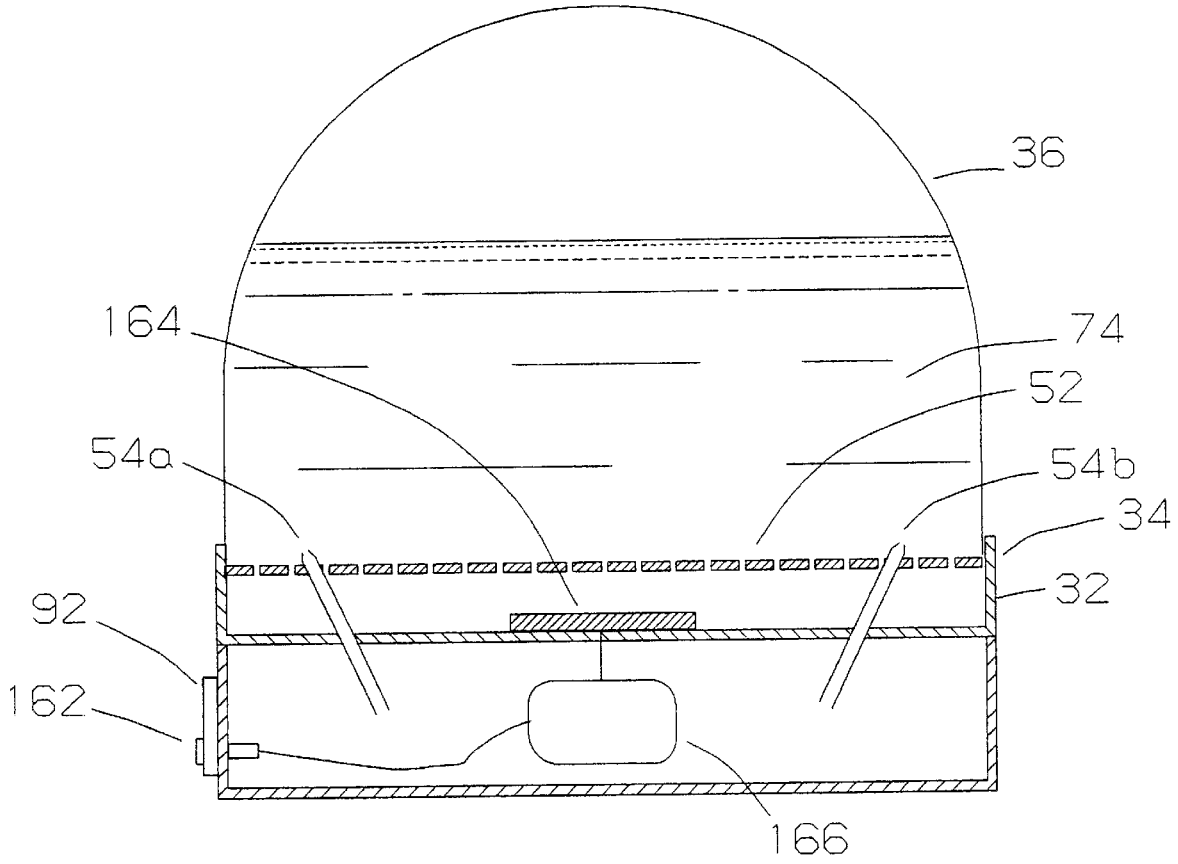
Figure 11:
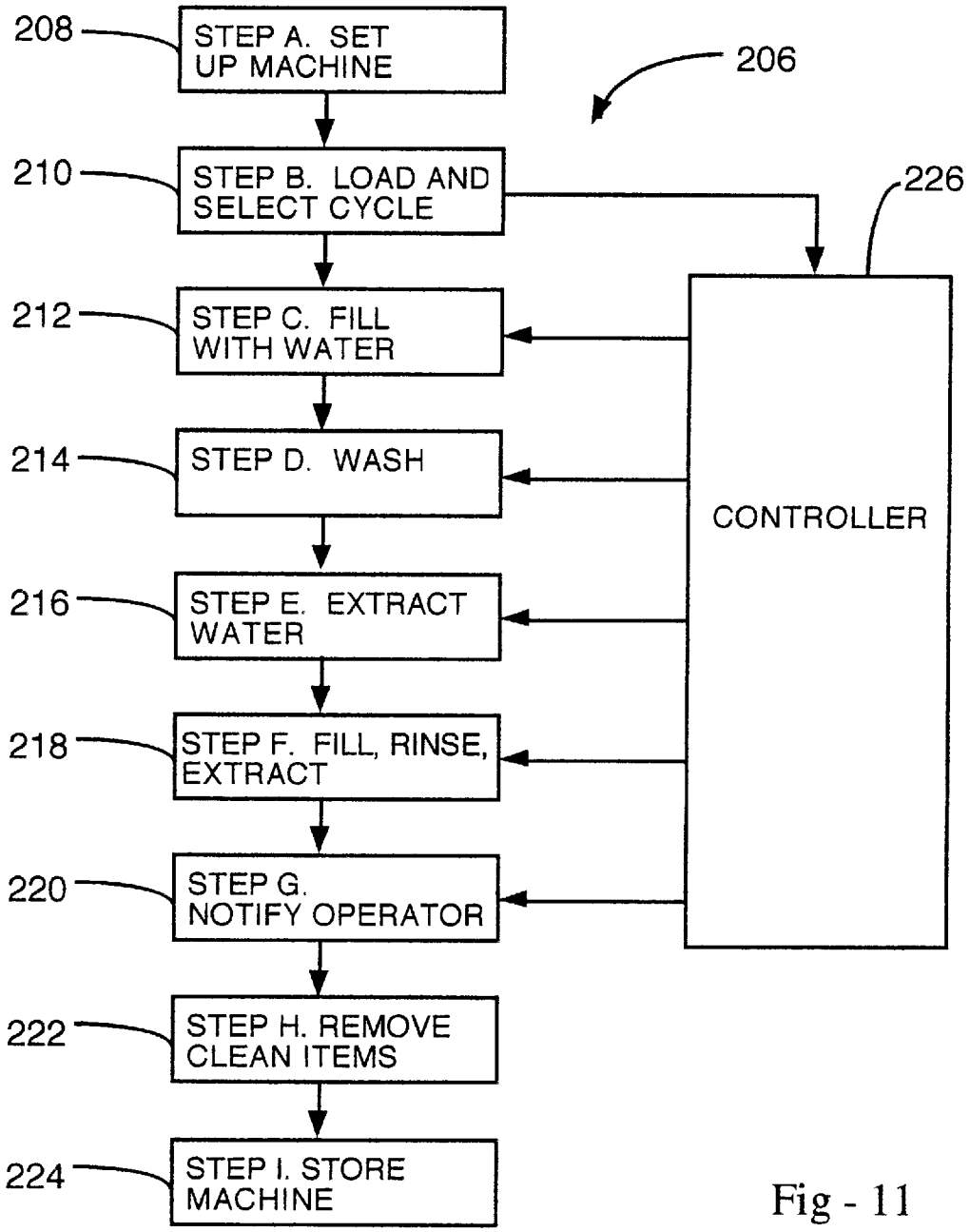

FIGS. 3*a* and 3*b* are side views of a preferred embodiment of an automatic washing machine according to the invention;

FIG. 4*a* is a plan view, FIG. 4*b* is a side view, FIG. 4*c* is an end view, and FIG. 4*d* is a perspective view of an alternate preferred embodiment of an automatic washing machine according to the invention;

FIGS. 5*a* to 5*c* are views of a wall mounted embodiment of an automatic washing machine according to the invention, FIG. 5*a* being a view of the front, and FIGS. 5*b* and 5*c* being side views with the wall cut away;

FIGS. 6*a* to 6*d* show various views illustrating the water extraction cycle of an automatic washing machine according to the invention;

FIGS. 7*a* to 7*g* show various views illustrating various scrubbing actions of the washing cycle of an automatic washing machine according to the invention;

FIG. 8 is a sectional view of an embodiment of an automatic washing machine utilizing a combination of at least two scrubbing actions according to the invention;

FIGS. 9*a* to 9*e* show various views illustrating various water treatment devices of an automatic washing machine according to the invention;

FIGS. 10*a* to 10*d* are various views of an enclosed bag, front loading, automatic washing machine according to the invention;

FIG. 11 is an overall functional block diagram of the inventive washing method.

DRAWING REFERENCE NUMERALS

20 rigid metal enclosure
22 water containing tub
24 perforated washing and spinning tub
26 transmission
28 motor
30 agitator
32 rigid housing, or base
34 container=bag 36 plus portion of housing 32
36 flexible bag
38 water pump
40 air pump
42 controlling device
44 flow diverter
46 water distribution manifold
52 screen
54 waterjets
58 opening at top of bag
60 drawstring tie
62 hinge
64 clasp
66 seal
68 bag holder
70 clothes retaining rack
72 air
74 dousing water, cleaning solution or fluid
76 items or articles (of laundry)
78 fill hose
80 drain hose
82 power cord with plug connectors on both ends
84 and 84', quick release hose connector
86 water tap
88 sink with drain
90 power cord connector
92 control panel
94 suitcase
96 suitcase lid
98 carrying handle
100 opening handle
102 wall mount bracket
104 backboard
106 backboard hinge
108 support cable
110 sideboard
112 backboard latch
114 vacuum
116 atmospheric pressure
118 air pressure channel
120 outer bag
122 pump assembly
124 electric motor
126 air check valve a
128 air check valve b
130 flow pattern
132 air vent or duct
134 low frequency vibrating disk
136 vibration drive unit
138 reversible rotating disk
140 reversible rotating drive unit
142 tilt
144 flexibly movable portion
146 actuator
148 actuator arm
150 flexjoint
151 pivot or hinge
152 ultrasonic generator
154 ultra sonic vibrator
156 ultrasonic vibration plate
158 sound generator/power amplifier
160 underwater speaker
162 inputjack
164 wide range underwater transducer
166 waveform generator/power amplifier
170 and 170', electrically polarized material
172 water flow
174 electrode containing aluminum
176 electrode containing carbon
178 section of pipe containing electrodes
180 magneticfield
182 and 182', magnet
184 section of pipe containing magnetic field
186 ultra violet light bulb
188 ultra violet light window
190 ultra violet light reflector
192 ultra violet light radiation
194 connecting point
196 neck of container
198 see through door
200 telescoping suitcase
202 left set of water jets
204 right set of water jets
206 functional block diagram of the inventive washing method
208 step a, set up machine
210 step b, load and select cycle
212 step c, fill with water
214 step d, wash
216 step e, extract water
218 step f, fill, rinse, extract
220 step g, notify operator
222 step h, remove clean items
224 step i, store machine
226 block labeled controller

SUMMARY OF THE INVENTION

In accordance with the present invention, an automatic washing machine comprises a container, at least partially constructed in the form of a flexible bag, a filling device, an agitating device, an extracting device, and a controlling device. Alternate embodiments further optionally comprise one or more of the features described in the following "Features of Invention."

Features of Invention

It may be helpful to the understanding of our automatic washing machine to categorize many of the features. Also included in this list are many features which have been gleaned from the prior art and are listed here as being examples of optional features that would be obvious to one versed in the art and for that reason are not included in the figures.

General Features

A feature of our automatic washing machine is a revolutionary new design based on the use of a flexible container, herein described as a flexible bag, which eliminates many heavy metal parts vital to the design of prior art machines. This elimination of parts drastically reduces the weight and space requirement of our automatic washing machine compared the weight and space requirement of prior art automatic washing machines.

A feature of our automatic washing machine is a collapsible container or vessel at least partially constructed in the form of a flexible bag, to contain a laundry solution such as water, and items of laundry to be washed.

A feature of our automatic washing machine is a flexible bag which is made of material of recent technology so as to be strong, collapsible and durable. An example of such a material is polyurethane coated fabric woven from aramid fiber.

A feature of our automatic washing machine is a scrubbing action for scrubbing items of laundry inside a flexible bag.

A feature of our automatic washing machine is vacuum wringing, which is the application of atmospheric pressure to wring the water from the laundry inside a collapsed flexible container. This vacuum wringing eliminates the vibration of the spin cycle which has been vital to prior art machines.

Scrubbing Features

A feature of our automatic washing machine is a choice of scrubbing actions such as agitation, vibration, rubbing, or other actions obvious to one versed in the art. Examples of such possible actions are: alternating deformation of the bag, injection and extraction of fluid into and out from the bag, motion imparted from a vibrating device inside the bag, motion imparted from a vibrating device outside the bag, circulating fluid inside the bag, circulating air bubbles within the fluid, rapid vibration of the fluid which results in cavitation, and other actions as may be obvious to one versed in the art.

In an embodiment, a method of agitation may be at least one or a combination of at least two scrubbing actions.

In an embodiment, a method of agitation is the use of multiple frequencies. A low frequency of agitation resulting in a sloshing action is augmented by a higher frequency agitating action resulting in cavitation.

In an embodiment, audio frequency vibration in the form of music is used alone or in combination with another frequency of agitating action. Music is from a conventional external source such as a home or portable stereo, fed to our automatic washing machine through an audio cable.

In an embodiment, motion of the laundry items being washed is accomplished by urging a circulating flow of water in the bag, and agitation is accomplished by reversing the flow of water in the bag.

In an embodiment, a manifold with water jets in at least two directions is used for reversing the flow of water. Each of the directions is used independently.

In an embodiment, a conventional reversible pump is used for reversing the flow of water.

In an embodiment, reversing the flow of water is accomplished by conventional automatically operated valves.

In an embodiment, any other washing or cleaning fluid obvious to one versed in the art may be substituted for water.

Space Saving Features

Our automatic washing machine occupies space normally dedicated to living only when in use. When use is finished living space again returns to be used for other activities of living.

Our automatic washing machine easily and conveniently collapses when not in use. With no requirement for a bulky agitator in our automatic washing machine the space occupied by the bag equivalent of a tub is reduced to negligible size for storage.

Our automatic washing machine is energy and space efficient. With no requirement for a steel enclosure, nor a steel water containing tub, nor a steel spinning tub, nor a bulky agitator, the mechanical apparatus of our automatic washing machine is much smaller and lighter. Being much smaller and lighter reduces the power required. With less power required to operate, a smaller motor and auxiliary apparatus are permitted. This further reduces the weight and results in the option to use lighter plastic instead of metal for the supporting structure Less weight and smaller motor result in increased energy efficiency.

Our automatic washing machine is able to be carried by one hand similar to a suitcase. When collapsed the present invention is carried out of the way when not in use. Light as a vacuum cleaner, the present invention is transportable. It can be easily carried as a piece of luggage while traveling.

The present invention stores easily in small space in a closet or on a shelf.

In an embodiment, the washing machine of this invention is produced in a form that can be mounted inside a wall of a house.

Our automatic washing machine enables those living in a house, apartment, or mobile home which is constructed without an area dedicated for the laundry, to enjoy the convenience of having a laundry facility in the home.

Control Features

Still another feature of our automatic washing machine is a controller which controls the various operations of the machine such that the washing proceeds automatically once the machine is loaded and turned on.

In an embodiment, as in prior art machines, a micro processor is used for control and logic means.

In an embodiment, as in prior art machines, a selector is provided for selection among multiple choices of the various phases and timing of the cleaning cycle depending upon the severity of the cleaning desired.

In an embodiment, as in prior art machines, a display is provided to keep the operator informed as to the progress of the cycle, and to alert the operator of any irregularities.

Filling Features

In an embodiment, as in prior art machines, an inlet and an outlet are provided to fill the machine with water and to empty it respectively.

In an embodiment, as in prior art machines, a water level sensing device is provided.

In an embodiment, as in prior art machines, a water pressure sensing device is provided to sense the level of water.

In an embodiment, a sensing device is provided detecting any leakage of the flexible bag before filling it with water. Such a sensing device may utilize air pressure inside the bag.

In an embodiment, a tilt sensor is used to prevent spilling water.

In an embodiment, the bag may be tapered so as to become narrower toward the top than at the bottom to overcome the tendency for the water filled bag to bulge or lean to one side and become unstable.

In an embodiment, as in prior art machines, a means is provided internal to the washing machine for mixing hot and cold water to achieve the desired water temperature.

In another embodiment, as in prior art machines, a means for controlling the water temperature is external in the form of a mixing faucet which supplies the water pre-mixed to the desired temperature.

Environmental Features

A feature of our automatic washing machine is increased efficiency gained by the use of a built in water treating device. Such devices include those utilizing various magnetic, ionic, electrolytic, electronic, cavitation, and radiation physical phenomena and as such are described in the literature and familiar to one versed in the art In an embodiment, a water treating process is the generating of hydroxyl ions in wash and rinse water by the electrolytic action of water contact with an electrically polarized material of which the washing bag is made, or which is make into the bag. An example of such a material is tourmaline.

In our automatic washing machine a flexible bag muffles the sound of washing and is quieter than the prior art while in operation.

In an embodiment, our automatic washing action generates a pleasant sound of music when operating.

Our automatic washing machine results in less injury to garments by elimination of the requirement for a mechanical agitator.

The present invention results in increased cleaning efficiency due to combined action of low frequency and high frequency agitation.

The aforementioned examples of features of the invention, will, in part, become obvious from the following more detailed description of the invention, taken in conjunction with the accompanying drawings, which form an integral part thereof. Although the list above contains many features, these should not be construed as limiting the scope of the invention but merely as providing illustrations of some of the presently preferred embodiments of the invention. This list is not to be taken as a complete list of the features obvious to one versed in the art, but as examples of many other features of prior art washing machines which are obviously adaptable to our machine.

Theoretical Basis

It may be helpful to understand the theory behind some features of this invention. While we believe this theory to be valid, we do not wish to be limited thereto as other considerations may be pertinent. The validity of the invention has been empirically established.

Overcoming Design Tradeoff Paradox

Conventional automatic washing machines must be big for the following reasons: 1) Automatic washing machines of the prior art use a washing method that requires an agitator to drag the clothes back and forth in the water. This agitator is large and bulky. 2) Automatic washing machines of the prior art use centrifugal force to extract the water between and after the dousing cycles of washing and rinsing. In practical use the load is not balanced and the machine must be heavy to keep the machine in place during the spinning cycle. This spinning cycle and the agitation method result in the requirement for several items which make the machine heavy, large, and non movable. These items include, (a) a heavy rigid metal enclosure, (b) a heavy metal tub for containing water, (c) a heavy metal perforated tub for washing and spinning, (d) an agitator to drag the clothes back and forth in the water.

(e) a heavy metal transmission, (f) a heavy large motor with sufficient power to move the heavy moving parts, Therefore, with the above design requirements, any attempt to make a machine of reduced size or weight is met with the required tradeoff of reduced capacity.

To eliminate this required tradeoff of reduced capacity is the challenge. To design an automatic washing machine with equal or increased capacity and efficiency while having less weight and size requires overcoming this seeming paradox. The revolutionary solution which eliminates the requirements for the tradeoff has several parts and was unobvious.

Steps of the Solution

1. Agitation Method Breakthrough

It has been found that if a plastic grocery bag is tied shut with fruit and water inside, nearly devoid of but including some air, and alternately squeeze it first on one side with one hand and then on the other side with the other hand, causing the water to rush by the fruit, being held in close proximity to the fruit by the plastic bag, the fruit is quickly washed with little abrasion damage to the fruit. Much riper fruit can be washed without damage by this method than by the spraying water method.

This method of washing is adapted to laundering clothes in this invention with the result of superior cleaning and less damage to the clothes being laundered. By experimentation, it been found that if a plastic grocery bag is tied shut with articles of laundry and water inside, nearly devoid of but including some air, and alternately squeezed first on one side with one hand and then on the other side with the other hand, a violent washing action is set up with little energy required. Such washing action is much less damaging to the laundry items. Yet, the laundry items are cleaned as effectively as though they were cleaned by the more destructive method of rubbing.

Of course, eventually the plastic grocery bag breaks and the water spills out. The grocery bag is not practical for that reason. However, with the recent advances in technology, there are much stronger materials available. An example of such a material is polyurethane coated fabric woven from aramid fiber.

A sheath of polyurethane coated fabric woven from aramid fiber may be used for making the flexible bag. However, other types of less expensive materials can obviously be substituted. A list of examples of obvious desirable properties of the material to use for construction of the flexible bag includes but is not limited to:

(a) flexible, such that it will collapse, but not stretch out of shape, (b) strong, such that it is puncture and stretch resistant, (c) durable, such that it will last for a thousand washes minimum, (d) abrasion resistant, (e) detergent resistant, (f) bleach resistant, (g) cleaning fluid resistant, (h) corrosion resistant, (i) hot water resistant, such that it will be able to stand up when filled with several gallons of hot water, (j) mildew resistant, (k) dimensionally stable, such that it will not stretch with age, such that it will be able to contain air pressure, (l) non-toxic, (m) able to withstand ultra sonic energy, (n) unaffected by dye, (o) electrically conductive or non conductive as is required by the particular embodiment, (p) electrically polarized as is required by the particular embodiment, and other desirable properties as is necessary for the functioning as described herein.

2. Water Extraction Method Breakthrough

It been found that if a plastic grocery bag is tied shut with articles of laundry and water inside, and a vacuum applied inside the bag, the grocery bag collapses due to atmospheric pressure. This collapse presses the water out of the articles of laundry inside the bag. Even more water is extracted by both mechanical and evaporative removal, when air is repeatedly allowed to re-enter the evacuated bag and the bag again evacuated. This method of water extraction is ideal for an automatic washing machine using a flexible bag for the washing container. The reduced atmospheric pressure at higher elevations may require artificial assistance. This reduced atmospheric pressure can be assisted easily by doubling the bag such that one bag is inside the other. Supplemental air pressure could be applied between the two bags to assist the atmospheric pressure in collapsing the inner bag, thus effectively wringing the water from the laundry. This method of supplemental air pressure may be used even at sea level if dryer laundry is desired. Thus, the spin cycle of prior art washing machines is eliminated.

With the spin cycle gone, the heavy parts requirement is gone. It may seem paradoxical that replacing big parts with small parts, metal with plastic and rigid with flexible, will improve the capacity and the cleaning properties of a washing machine. However, the result has been empirically verified. With this invention, less works better.

Water Treatment Theory

There are various water treatment methods in the prior art that empirically have been shown to improve the cleaning effectiveness of water. Water softening methods result in less soap or detergent being required. Magnetic water treatment prevents and removes lime scale. Electrolytic or ionic treatment improves the cleaning properties of water. Hypothetically this improvement is attributed to the reduction of the surface tension due to ion release. Other methods of ion release are found in the prior art, and obviously are adaptable to the present invention.

One method of ion release in the prior art that is easily adapted to the present invention is described in U.S. Pat. No. 5,309,739 to Lee (1994). In his patent, Lee uses tourmaline, an electrically polarized material which has been demonstrated to produce an increase in the effectiveness of the cleaning ability of water when the water is agitated in the immediate vicinity of the electrically polarized material. In our automatic washing machine tourmaline may be used, or alternatively, the bag may be made of a manufactured electrically polarized material. Additionally, the washing action can result in agitation of the water in the immediately vicinity of the surface of the bag which is electrically polarized, resulting in that same increase in washing effectiveness.

The increased cleaning effectiveness described in U.S. Pat. No. 5,309,739 to Lee (1994) is attributed by Lee to ion generation. Other methods of ion generation are described in other patents as mentioned in the prior arts section above. Obviously, any of these methods are adaptable to our inventive automatic washing machine.

U.S. Pat. No. 5,599,455 to Hukai (1997) presents a theoretical basis for the improved cleaning effectiveness of tourmaline treated water which attributes the effect to the generation of hydroxyl ions ($H_3O_2^-$) and hydronium ions ($H_3O^+$) both having detergency. Other hypothetical explanations are abundant in the literature. One hypothesis is that the ions improve the washing effectiveness of the clothes washing machine by lowering the surface tension of the wash water due to the ionic surface active effect. It is natural that when the surface tension of the wash water is reduced, the amount of detergent necessary to clean the laundry is also reduced.

DETAILED DESCRIPTION OF THE PREFERRED EMBODIMENTS

As will become obvious, there are multiple preferred embodiments of the present invention. One is a stand alone unit, fully collapsible into a suitcase, another is a unit designed to be built into a wall of a house, others will be obvious adaptations to the environment where the invention will be used or stored. The same part numbers are used for the same functional part in all of the figs even though the shape may be different in different embodiments.

Figure 1:
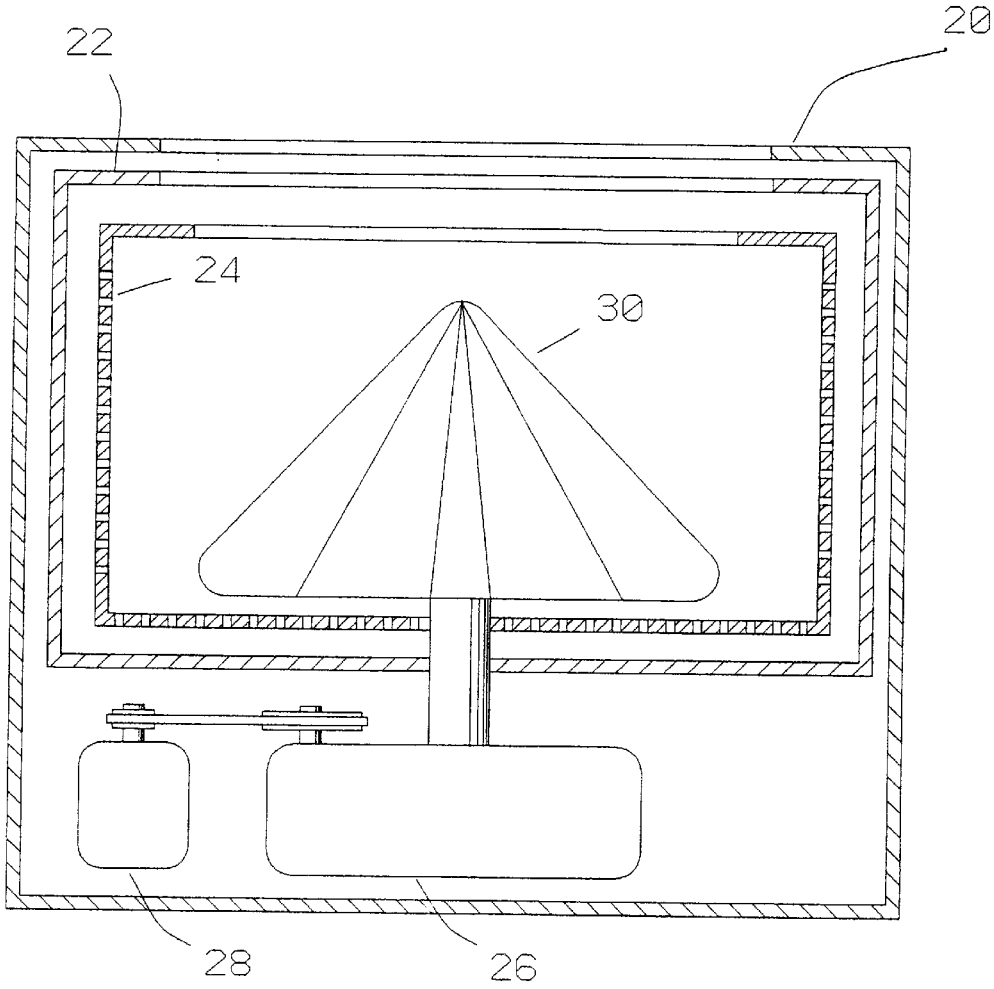
FIG. 1 is a sectional view of a typical automatic washing machine according to the prior art.

FIG. 1 illustrates an example of an automatic washing machine illustrating the major components necessary in an automatic washing machine design according to the prior art. The machine of the prior art comprises a rigid metal enclosure 20, a water containing tub 22, a perforated washing and spinning tub 24, a heavy transmission 26, a heavy motor 28, a bulky agitator 30, and many other smaller conventional parts such as a control panel (not shown) well known to anyone versed in the art. Motor 28 drives transmission 26 which in turn drives agitator 30, causing agitator 30 to reciprocate, or drives spinning tub 24 causing it to spin, depending on which cycle is currently in progress. In prior art automatic washing machines these illustrated parts are a necessary part of the design to make the machine automatic.

The prior art design for a washing machine requires agitator 30 for scrubbing the clothes. Motor 28, and transmission 26 are necessary to drive agitator 30.

The prior art design for a washing machine to be automatic requires a method of removing the water from the clothes without lifting the clothes from the water. To accomplish this spinning tub 24 is required. Motor 28, and transmission 26 are necessary to drive spinning tub 24 This design requires the machine to be much heavier than the load of clothes being spun because the load in practical use is never completely balanced. This imbalance causes the machine to move around during the spin cycle unless the machine is heavy enough to stay in place.

In using the prior art machine of FIG. 1, the top is opened, dirty clothes and a little detergent are put inside, the top is closed, the desired cycle is selected, and the power is turned on. The machine automatically begins to fill with water. Later, the operator returns, opens the top, and removes the clean clothes.

Figure 2:
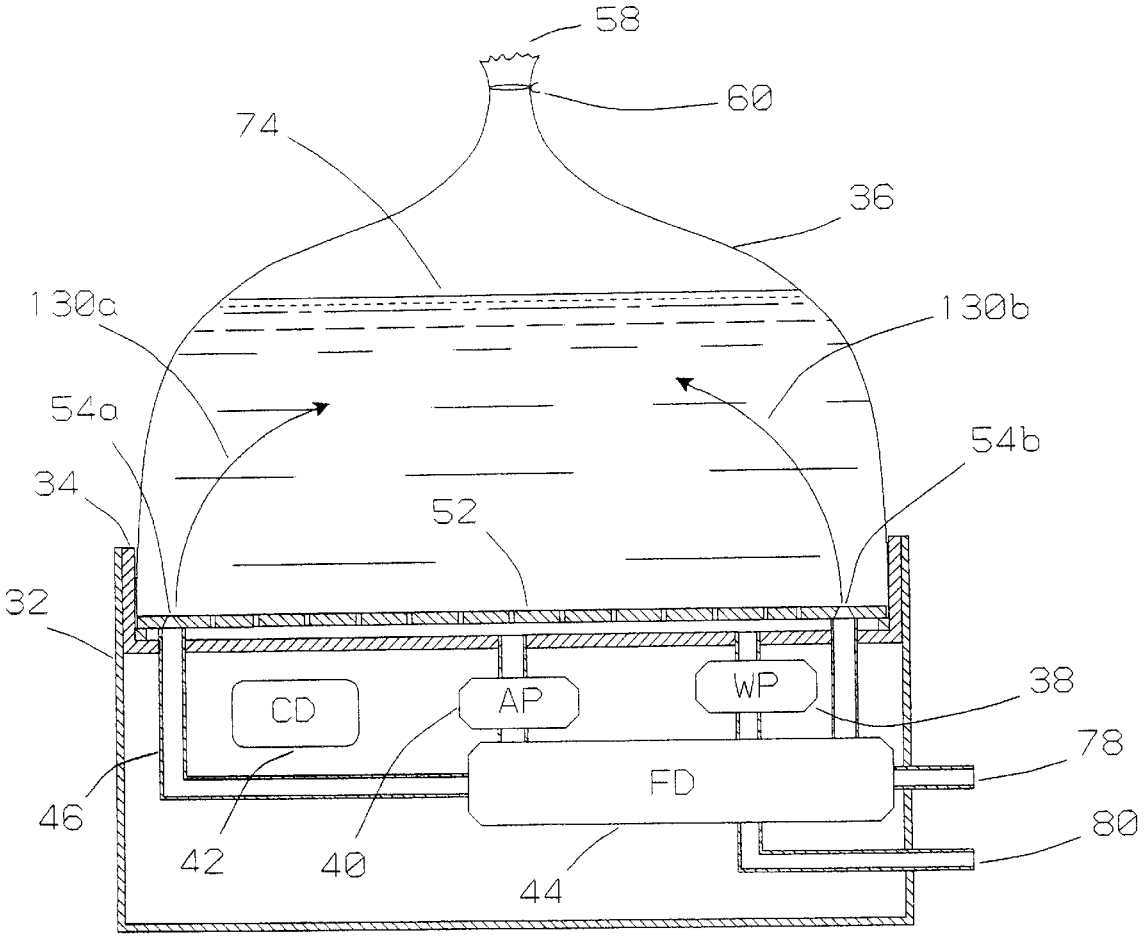
FIG. 2 is a sectional view of the first embodiment of an automatic washing machine according to the invention.

FIG. 2 illustrates a first embodiment of the automatic washing machine of the present invention. This automatic washing machine has a rigid housing, or base 32 of which the top portion is the lower portion of a water container 34. The top portion of container 34 is a flexible bag 36. Inside the lower portion of housing 32 are a water pump 38, an air pump 40, a controlling device 42, a flow diverter 44, and a water distribution manifold 46. Inside container 34 is a screen 52, and a pair of water jets 54*a* and 54*b*. A conventional filling hoses 78, conventional check valve (not shown), conventional fill valves (not shown), a drain hose 80, and conventional power cord (not shown) complete the apparatus of the automatic washing machine. Flexible bag 36 is collapsible so as to fold down into the top portion of housing 32 for storage. Flexible bag 36 is made of material of recent technology so as to be strong, collapsible and durable. An example of such a material is polyurethane coated fabric woven from aramid fiber. An opening 58 at the top of flexible bag 36 is opened and closed by means of a drawstring tie 60. Housing 32 and screen 52 are made of conventional plastic having a heat resistance up to over 200 degrees Fahrenheit. Water pump 38 is a conventional water pump of similar size and capacity that would be used on a conventional automatic electric dishwasher. Water pump 38 is connected to pump water from the water container 34 portion of housing 32 to flow diverter 44, Flow diverter 44 is a series of conventional valves (not shown) controlled by controlling devise 42. Flow diverter 44 is connected to supply water from water pump 38 through water distribution manifold 46 to waterjets 54*a* and 54*b* alternately for agitating, or to drain hose 80 for emptying. Air pump 40 is a conventional vacuum cleaner type air pump and is connected to force air from the atmosphere into container 34 or out of container 34 into the drain hose, as controlled by controlling device 42. A conventional check valve (not shown) is part of air pump 40 to prevent water from flowing out an atmospheric air intake vent (not shown). Controlling device 42 is a standard timing and control device. The wiring and constructional details of timers for operating a machine cycle are so well known to those skilled in the art, that no description of them is contained herein.

The washing and rinsing action, and the water extraction method of the inventive machine are of unique design and are described in detail in FIGS. 6*a* to 7*g*.

In use, the inventive automatic washing machine of FIG. 2 is quite similar to the use of the automatic washing machine of FIG. 1 of the prior art. In using the prior art machine of FIG. 1, the top is opened, dirty clothes and a little detergent are put inside, the top is closed, the desired cycle is selected, and the power is turned on. The machine automatically begins to fill with water. Later, the operator returns, opens the top, and removes the clean clothes. Likewise, in using the inventive machine of FIG. 2, the top is opened, dirty clothes and a little detergent are put inside, the top is closed, the desired cycle is selected, and the power is turned on. The machine automatically begins to fill with water. Later, the operator returns, opens the top, and removes the clean clothes. Thus from the operators perspective, the operation of the inventive machine of FIG. 2 is identical to the familiar operation of the prior art machine of FIG. 1.

The inventive automatic washing machine of FIG. 2, however, is much smaller and lighter while still having essentially the same load capacity as the prior art machine of FIG. 1:

Where the prior art machine of FIG. 1 has a heavy, rigid metal enclosure 20 and a heavy rigid water containing tub 22, the inventive machine of FIG. 2 has combined the two into a rigid housing, or base 32 of much lower profile and made of a lighter material. An example of the lighter material is plastic. The lower portion of tub 22 in FIG. 1 has been built into the upper portion of housing 32 of FIG. 2. The upper portion of tub 22 in FIG. 1 has been replaced in FIG. 2 with a flexible bag 36 having opening 58 at the top which is secured by a drawstring tie 60. In FIG. 2 upper portion of housing 32 and flexible bag 36 together make a container 34 for holding a dousing water 74 for washing or rinsing.

Where the prior art machine of FIG. 1 has a heavy metal perforated washing and spinning tub 24, the inventive machine of FIG. 2 has none. The water extraction method of the inventive machine of FIG. 2 has eliminated the need for spinning tub 24 of the prior art machine of FIG. 1.

Where the prior art machine of FIG. 1 has a bulky agitator 30 taking space in tub 22, the inventive machine of FIG. 2 has a pair of waterjets 54*a* and 54*b*. In the inventive machine of FIG. 2 no space is taken up inside container 34 with bulky parts.

Elimination of spinning tub 24 and agitator 30 also eliminates the need for transmission 26 and heavy motor 28 of FIG. 1. The inventive machine of FIG. 2 replaces those heavy parts with a water pump 38 and air pump 40 which are smaller and lighter and fit easily inside housing 32.

The remaining parts necessary to complete an automatic washing machine are familiar conventional parts which are obvious to one versed in the art, such as mixing and filling valves (not shown), filling hose 78 and drain 80, a power cord (not shown), a conventional controller (not shown) and other items irrelevant to the invention.

Thus, with the elimination of the need for the six most heavy and bulky parts of the prior art, the inventive machine of FIG. 2 is but a fraction of the size and weight, while still having the same capacity and functionality as the prior art machine.

FIG. 3*a* and FIG. 3*b* illustrate a preferred embodiment of the automatic washing machine of the present invention. This preferred embodiment is very similar to the embodiment illustrated in FIG. 2, but has no opening in the top of bag 36. Instead, in this preferred embodiment, container 34 is opened by separating bag 36 portion of container 34 from housing 32 portion of container 34. There is a bag holder 68 around the bottom opening of bag 36 which holds bag 36 securely against a seal 66 when bag 36 and holder 68 are closed down onto housing 32. A hinge 62 and a clasp 64 secures holder 68 to seal 66. A clothes retaining rack 70 is also attached to hinge 62 and snaps into bag holder 68.

The washing and rinsing action, and the water extraction method of the inventive machine are of unique design and are described in detail in FIGS. 6*a* to 7*g*.

The use of this embodiment of the automatic washing machine is very similar to the use of the machine illustrated in FIG. 2. The difference in use is in the opening of bag 36 to insert and remove the articles of laundry. Instead of opening drawstring 60, to open bag 36, in the embodiment of FIG. 3*a* and FIG. 3*b*, the operator opens clasp 64 and raises bag holder 68 including bag 36 in a similar manner as opening the lid on a conventional prior art top loading washing machine. Once bag holder 68 is raised, rack 70 is snapped out of bag holder 68 and the dirty clothes are put into bag 36. After bag 36 is filled, rack 70 is snapped back into bag holder 68 and bag holder 68 is lowered and attached with clasp 64, thus insuring a water tight closure against seal 66 on housing 32.

FIG. 3*b* also illustrates the conventional water, drain, and power hookups used in this embodiment. A fill hose 78 with a quick release hose connectors 84 and 84' on either end, and a drain hose 80 with a quick release hose connector 84 on the end connected to housing 32 provide a temporary connection to a water tap 86 and a sink with drain 88. A power cord 82 with conventional plug connectors on both ends provides a temporary connection to electric power while in use.

The use of the conventional water, drain, and power hookups used in this embodiment is simplified by quick release hose connectors 84. Water hose 78, drain hose 80 and power cord 82 are removed from their place of storage. Water hose 78 and drain hose 80 are connected to their respective mating quick release hose connector 84 on housing 32. The other end of water hose 78 is connected to mating quick release connector 84' previously installed on a convenient water tap. The other end of drain hose 80 is hooked over the edge of a sink with drain such that water from drain hose 80 goes down the drain. Connecting power cord 82 to an appropriate connector 90 on housing 32 and to a conventional electric outlet (not shown) complete the hook-up.

FIGS. 4*a* to 4*d* illustrate an alternate preferred embodiment of the automatic washing machine of the present invention. FIG. 4*a* is a plan view with a suitcase type lid 96 swung open. FIG. 4*b* is a side view with lid 96 removed. FIG. 4*c* is an end view showing bag 36 and housing 32 to be less tall than wide. FIG. 4*d* is a perspective view prepared for storage. This alternate preferred embodiment is very similar to the embodiment illustrated in FIG. 3*a* and FIG. 3*b,* which has a vertically oriented bag 36, except the orientation of bag 36 of the embodiment shown in FIGS. 4*a* to 4*d* is horizontal and bag 36 separates from housing 32 opening to the side (not shown), in the same direction as lid 96 is shown open. Instead of bag 36 setting on housing 32, this embodiment has bag 36 laying on a horizontal surface (not shown) and housing 32 standing at one end of bag 36. The arrangement of hinge 62 and clasp 64 are the same. There is no need for rack 70 of FIG. 3, because articles 76 are inserted deeper into bag 36 of this embodiment as the bag of this embodiment is longer. To open this machine housing 32 is swung away from bag 36. A control panel 92 is conveniently located on the top side of housing 32. When closed and operating, water 75 inside bag 36 is supported by any horizontal surface such as a floor (not shown) on which bag 36 is laying. Air 72 in bag 36 is in contact with housing 32 making the sensing of the level of water simpler. In this embodiment, the vertical dimension of housing 32 need only be a little greater than the depth of water 74. This results in housing 32 being smaller and more compact for storage. When in use, bag 36 hangs out the side of housing 32, which appears like a suitcase with a bag hanging out of it. When not in use, bag 36 collapses conveniently into housing 32 and housing 32 is converted into a suitcase 94. Suitcase lid 96 swings closed over the bag (and other attachments). A carrying handle 98 on top of housing 32 provides a convenient way to carry the machine into storage.

FIGS. 5*a*, to 5*c* illustrate a wall mounted embodiment of the automatic washing machine of the present invention. Housing 32 is the door of a front loading automatic washing machine of this invention when the machine is mounted inside a wall. From the front the wall mounting model looks similar to the separate freezing compartment door of a top freezer refrigerator. This is illustrated in FIG. 5*a*. This embodiment of the automatic washing machine is very similar to the embodiment illustrated in FIGS. 4*a* to 4*d*. The machine of FIGS. 4*a* to 4*d,* as shown in FIG. 5*b,* has been modified and fitted with a wall mount bracket 102 and a backboard 104, that folds down to become the surface on which bag 36 rests. Backboard 104 is connected to wall mount bracket 102 by a backboard hinge 106. Backboard 104 is normally folded up against the wall on the back side of the wall so as to not use any space out of the room on the back side of the wall. This folded configuration is illustrated in FIG. 5*c*. The configuration of hinge 62 is of somewhat different design to accommodate the wall bracket, but serves the same purpose as in the other embodiments. Housing 32 is constructed in the shape of a deep door which nearly fills the depth of the wall. Seal 66 is at the back edge of housing 32 so as to mate with bag holder 68. Bag holder 68 is permanently affixed to wall bracket 102 near the back side of the wall. Water hose 78, drain hose 80, and power cord 82 are permanently affixed to housing 32 with conventional strain relief (not shown), and are permanently affixed to plumbing and power inside the wall as in a conventional washing machine installation (not shown). In this embodiment seal 66 and bag holder 68 are oval or rectangular in shape, as in FIGS. 4*a* to 4*d,* rather than round as in some other embodiments, otherwise they function the same. When put away, bag 36 is collapsed into housing 32 and covered by backboard 104. When in use, backboard 104 is lowered down to a nearly horizontal position and bag 36 expands rearward and rests on backboard 104. A sideboard 110 on each side of backboard 104 and attached to backboard 104 keeps bag 36 from hanging over the side of backboard 104. Handle 100 serves to open the door which is housing 32. The door is equipped with a conventional interlock (not shown) to prevent opening the door at the wrong time and spilling water. Such a conventional interlock is common on prior art front loading automatic washing machines.

FIGS. 6*a* to 6*d* are included to illustrate the water extraction cycle of an automatic washing machine according to the present invention. This water extraction cycle is quite different than the water extraction cycle of the conventional washing machine of the prior art. This water extraction cycle can be visualized as having two phases.

In the first phase, water and air are pumped out. In the second phase, air is pumped in. The two phases are repeated a reasonable number of times to extract as much water as is practical without damage to the clothes.

Figure 6A:
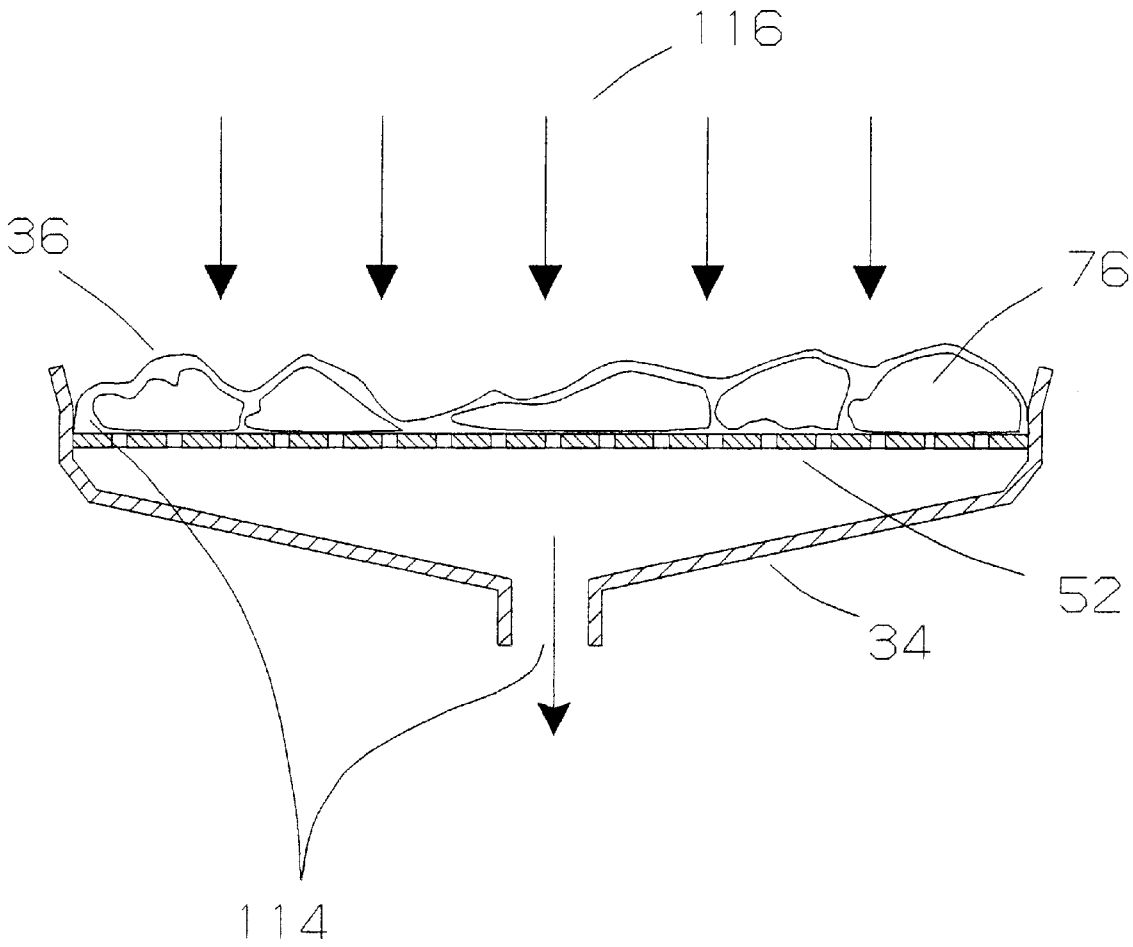

FIG. 6*a* illustrates phase 1. In Phase 1 air and water is pumped out of container 34. After water pump 38 (not shown) pumps out all the readily available water, vacuum 114 is applied from air pump 40 (not shown) to evacuate container 34, causing available atmospheric pressure 116 to collapse bag 36, pressing articles 76 to screen 52, thereby wringing water from articles 76. After a short time of the wringing of phase 1, phase 2 is started.

Figure 6B:
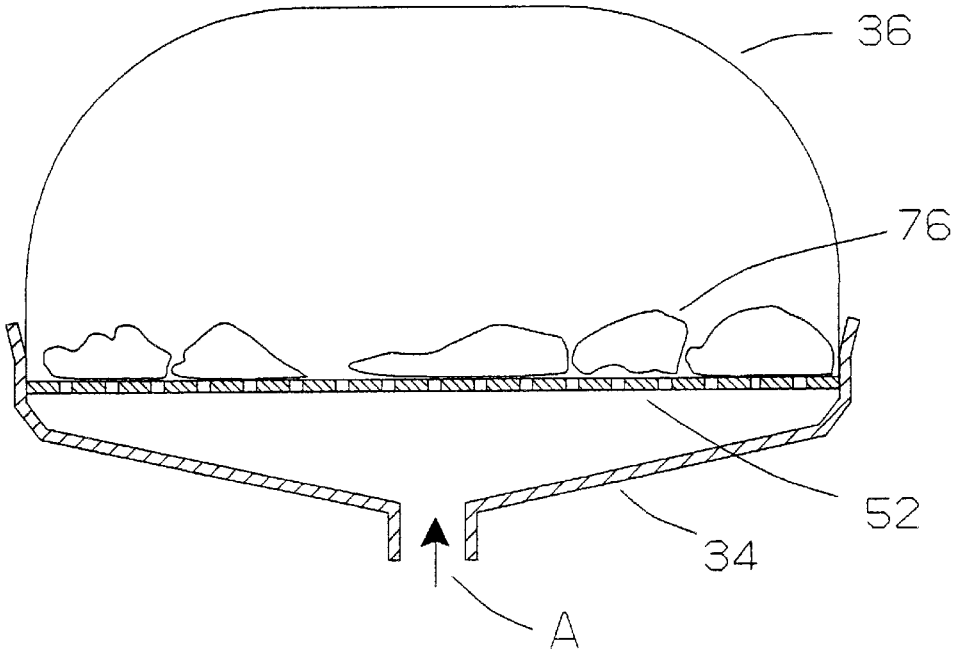

FIG. 6*b* illustrates phase 2. In Phase 2 air pressure from air pump 40 is forced into container 34 causing articles 76 to relax and bag 36 to inflate.

Again, after a predetermined short time, phase 1 and phase 2 are repeated a predetermined number of times. This repeated inflating and deflating of bag 36 moves air through articles 76 and results in both mechanical and evaporative removal of water. The final water extraction cycle contains a predetermined greater number of repeats than an extraction cycle that occurs before a rinse cycle. It is not as necessary to get articles 76 as dry when the next step, see FIG. 11, is entering a rinse cycle where they again get wet.

Figure 6C:
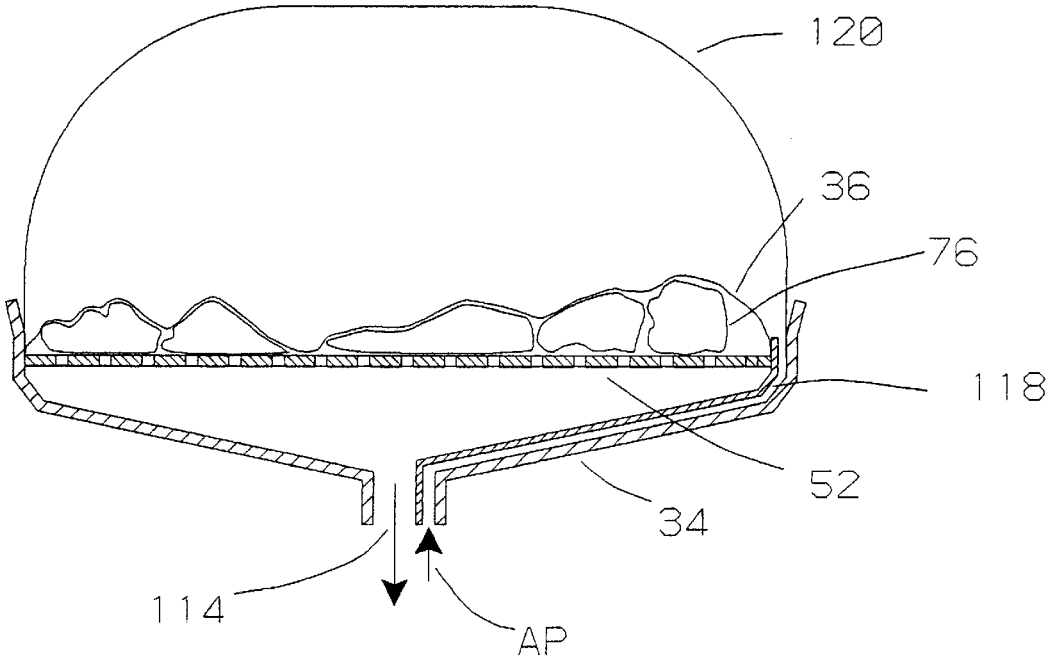

FIG. 6*c* illustrates a means for wringing increased amounts of water from articles 76 when drier articles 76 are desired. Atmospheric pressure 116 of phase 1 is assisted by air pressure from a pump assembly 122, shown in FIG. 6*d*. An outer bag 120 in addition to bag 36 is supplied to contain the assisting air pressure. An air pressure channel 118 conducts the additional air pressure from pump assembly 122 into air containing bag 120. Simultaneously vacuum is applied from pump assembly 122. This additional air pressure assists the natural atmospheric pressure collapse bag 36 and wrings additional water from the clothes.

Figure 6D:
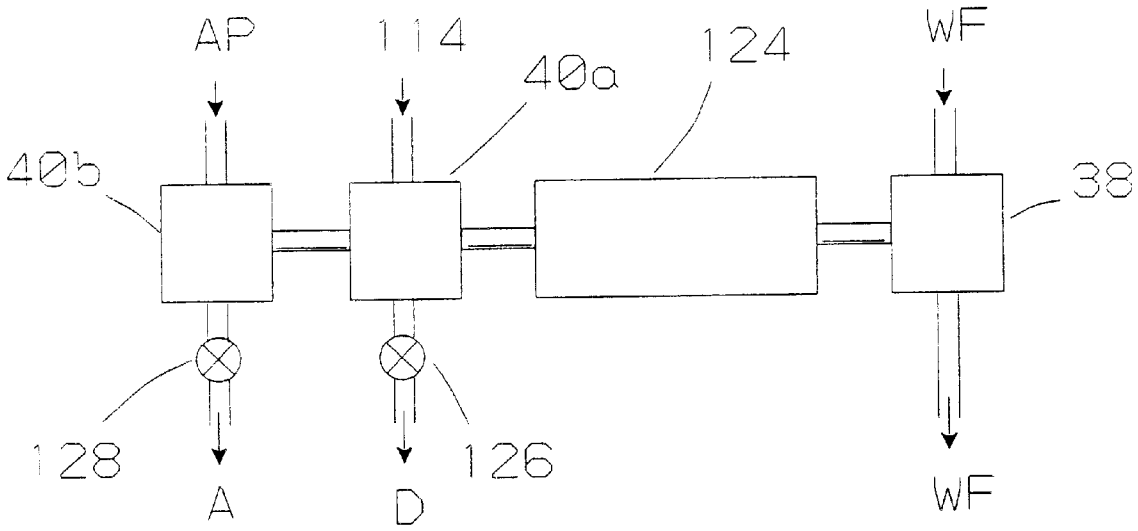

FIG. 6*d* illustrates air and water pump assembly 122 which is somewhat non-standard and would be suited for this application. Pump assembly 122 replaces three separate pumps with their own electric motors. An electric motor 124, water pump 38, air pumps 40*a* and 40*b,* a check valve a 126, and a check valve b 128, are parts of pump assembly 122. Electric motor 124 is a multi speed motor which speeds up when the load of water pump 38 is gone due to all the water being pumped out. When motor 124 is running at high speed, vacuum is available from air pump 40*a* and air pressure is available from air pump 40*b*. Check valves 126 and 128 prevent back flow.

FIGS. 7*a* to 7*g* show various views illustrating the detail of the agitation and scrubbing action of the washing and/or rinsing cycle of an automatic washing machine according to the present invention. The scrubbing action occurs as a result of mechanical agitation. As a result of this scrubbing action, the clothes wash against each other, against the sides of the washing machine, against air bubbles in the water, and against the water itself. This scrubbing accomplishes several things including the loosening of solid material on the surface of and imbedded in the fabric of the clothing, the dissolving of solids, the generation of ions, the emulsification of oil, and the rinsing away of foreign material, be it solid, emulsified, or dissolved. Various embodiments have different methods of inducing agitation.

Figure 7A:
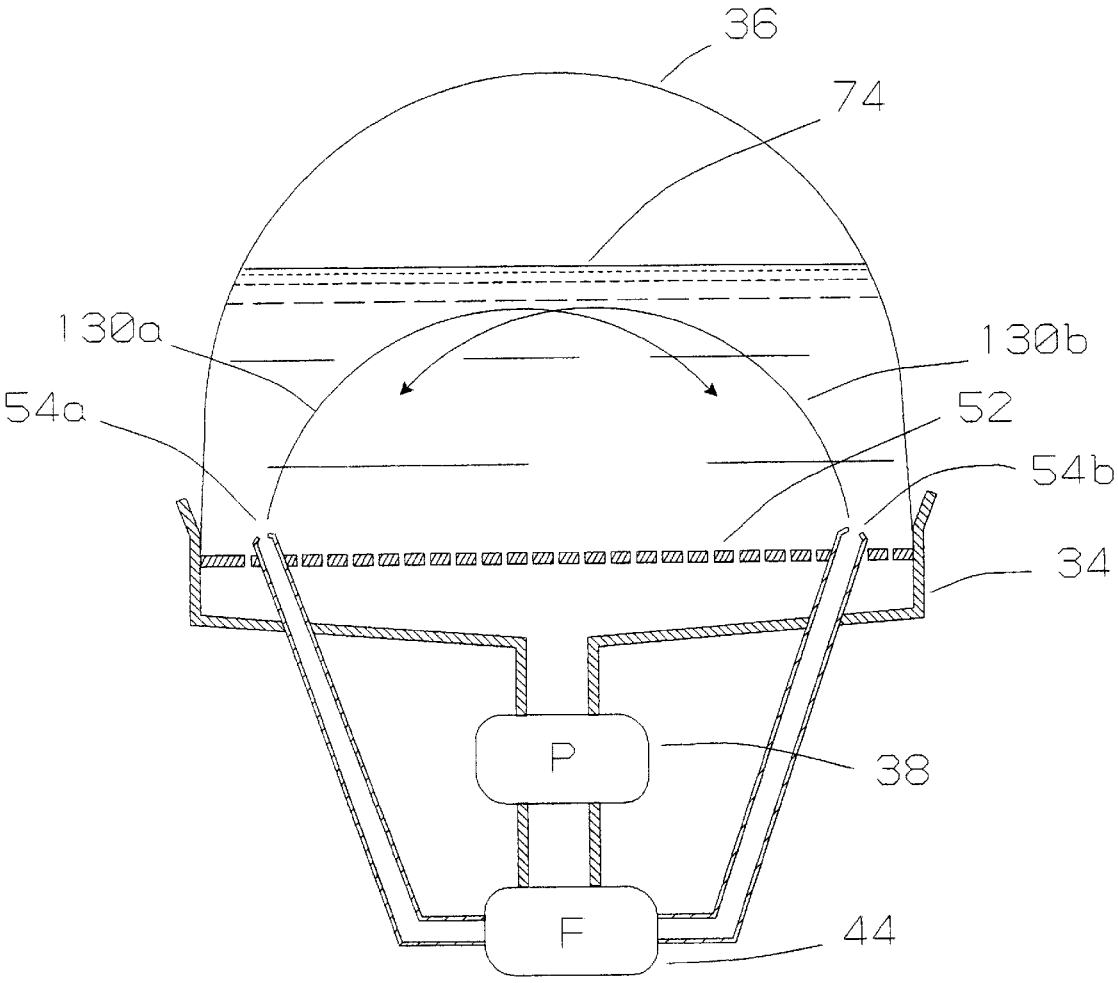

FIG. 7*a* illustrates the water jet method of inducing action. Action is induced in water 74 inside bag 36 by means of water jets 54*a* and 54*b* through which water is forced by water pump 38. Flow of water 74 inside bag 36 follows a flow pattern 130*a* or a flow pattern 130*b*, depending on the predetermined direction and predetermined angle jet 54*a* and jet 54*b* are mounted, and on which of these jets are currently in use. Flow diverter 44 is connected after water pump 38 and before jets 54*a* and 54*b*. Flow diverter 40, under the control of controlling device 42 (not shown), causes flow to be diverted to one or the other, or to both simultaneously. Jets 54*a* and 54*b* are independently active causing the pattern of flow to be at one time in one direction and at another time in another direction, thus disrupting flow pattern 130*a* or 130*b* and causing agitation. Different predetermined mounting positions and predetermined numbers of jets 54 are used in different embodiments to achieve the same results as is obvious to one versed in the art.

Figure 7B:
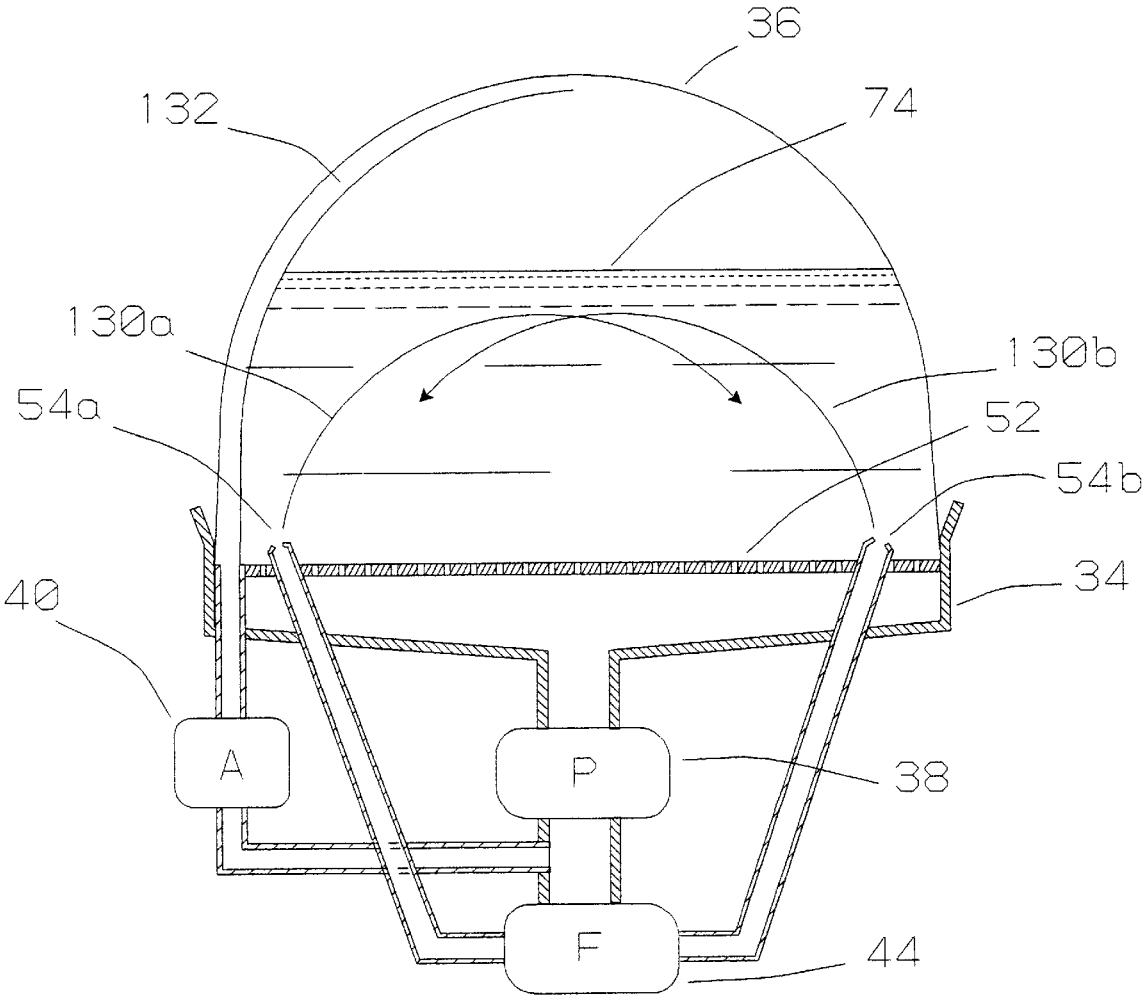

FIG. 7*b* illustrates the water jet plus air bubbles method of inducing action. Action is induced in water 74 inside bag 36 by means of water jets 54*a* and 54*b* through which water and air are forced by water pump 38 and air pump 40. This is achieved by locating air pump 40 such that air is introduced in the flow of water between water pump 38 and flow diverter 44. Excess air rises to the top of the wash water and is allowed to escape via an air vent or duct 132 which recycles the air to air pump 40. Air bubbles in the water increases the action over water alone. While washing without sudsing detergent or soap, air bubbles would give the pleasing appearance of suds to homemakers who judge cleaning power by the amount of suds. When using sudsing detergent, a control cycle would be selected that did not use the air feature. The vertical embodiment is illustrated in FIG. 7*b*. However, implementation in the horizontal, or front loader, embodiment (implementation not shown) would result in a simpler arrangement of duct 132.

Figure 7C:
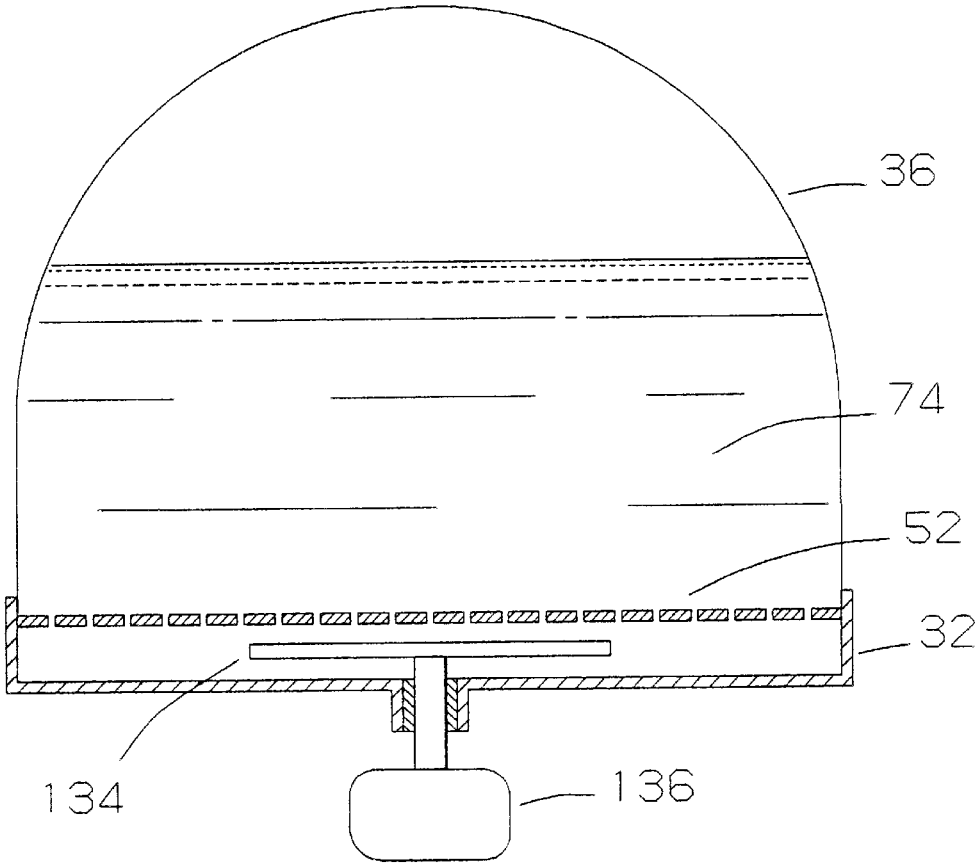

FIG. 7*c* illustrates the low frequency vibrating disk method of inducing action. Action is induced in water 74 inside bag 36 by means of a low frequency vibrating disk 134 causing a conventional resonance phenomena (not shown). Disk 134 is driven into vertical vibration by the drive force of a vibrating drive unit 136. An alternate location for disk 134 is above screen 52 (alternate location not shown).

Figure 7D:
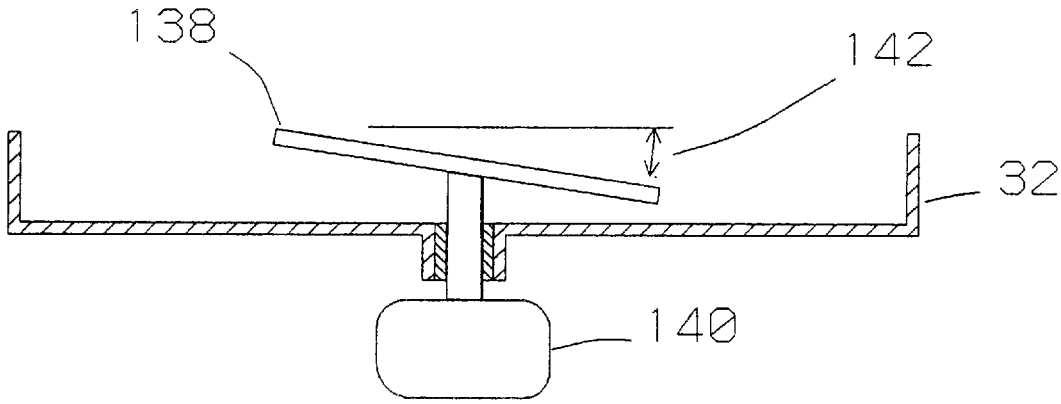

FIG. 7*d* illustrates the reversible rotating disk method of inducing action. Action is induced in water 74 inside bag 36 (shown in FIG. 7*c*) by means of a reversible rotating disk 138 causing a conventional resonance phenomena (not shown) similar to low frequency vibrating disk 134 shown in FIG. 7*c*. Disk 138 in FIG. 7*d* is rotationally driven by the drive force of a reversible rotating drive unit 140. Rotating disk 138 differs from vibrating disk 136 in that rotating disk 138 has a predetermined tilt 142 to one side such that when rotating, it moves water up and down on opposite sides of disk 138. The rotation of disk 138 also sets up a swirling action in the water. The rotation direction of disk 138 reverses every predetermined number of seconds to prevent setting up a violent swirling action in the water. This reversal pattern produces agitation instead of swirling.

Figure 7E:
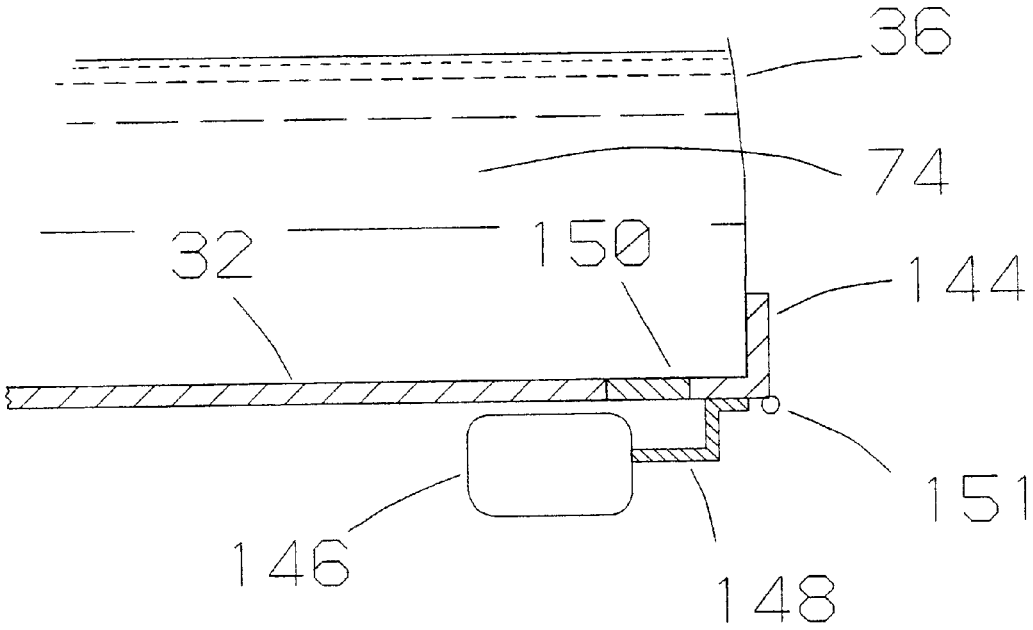

FIG. 7*e* illustrates the sloshing sideboards or baseboard method of inducing action. Action is induced in water 74 inside bag 36 by means of a portion or portions of sloshing sideboards or baseboard resulting in squeezing, shaking, jiggling, or bumping. This action causes a sloshing movement of the contents of bag 36. A flexibly movable portion 144 of housing 32 is jostled by the force of an actuator 146 through an actuator arm 148. Portion 144 is flexibly movable by virtue of a flex joint 150 and a pivot or hinge 151. In FIG. 7*e* one side is shown, however, multiple sides are so equipped resulting in opposing motion.

Figure 7F:
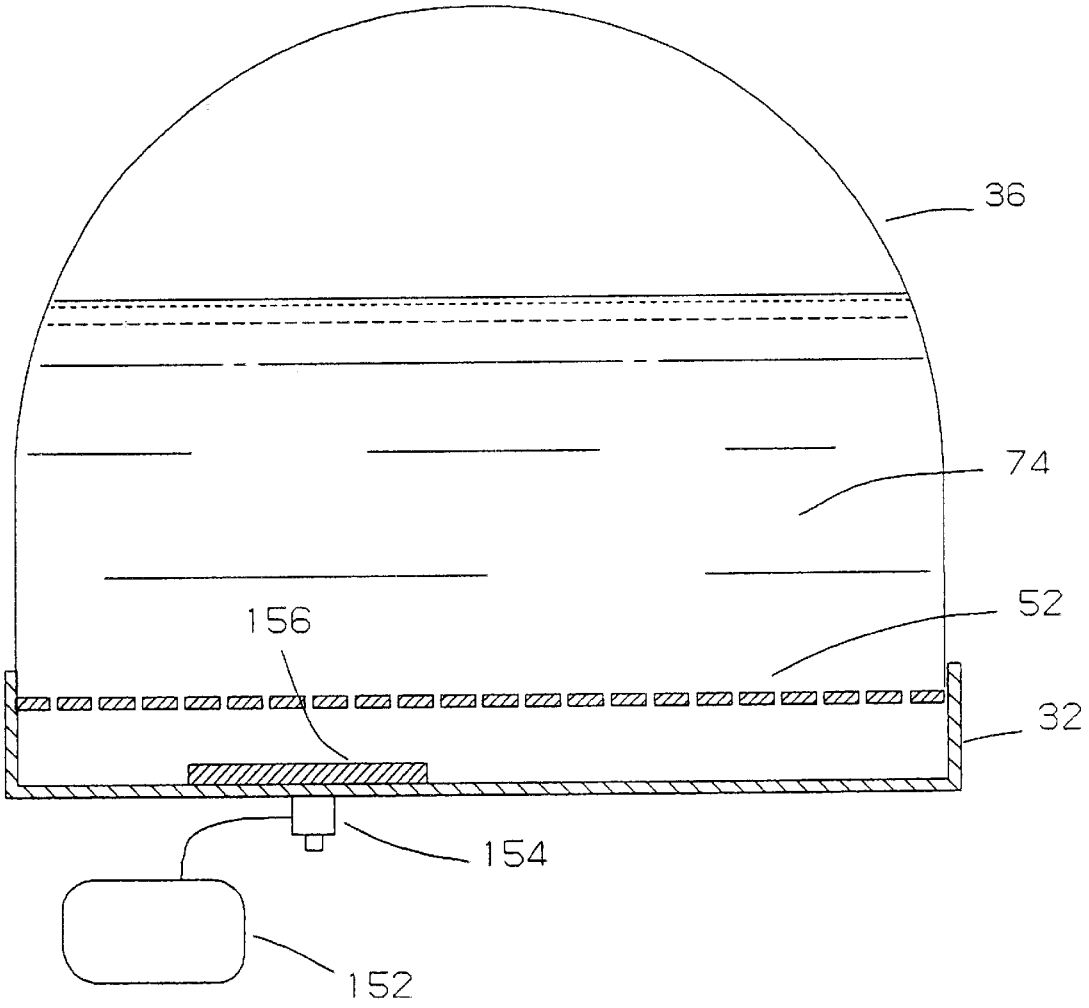

FIG. 7*f* illustrates the ultra sonic vibration method of inducing action. Action is induced in water 74 inside bag 36 by means of inducing ultra sonic vibrations resulting in cavitation, a very effective means of cleaning. An ultrasonic generator 152 is electrically connected to an ultrasonic vibrator 154. Ultrasonic vibrator 154 and an ultrasonic vibration plate 156 are mounted on housing 32 such that ultrasonic vibrations are induced in water 74.

Figure 7G:
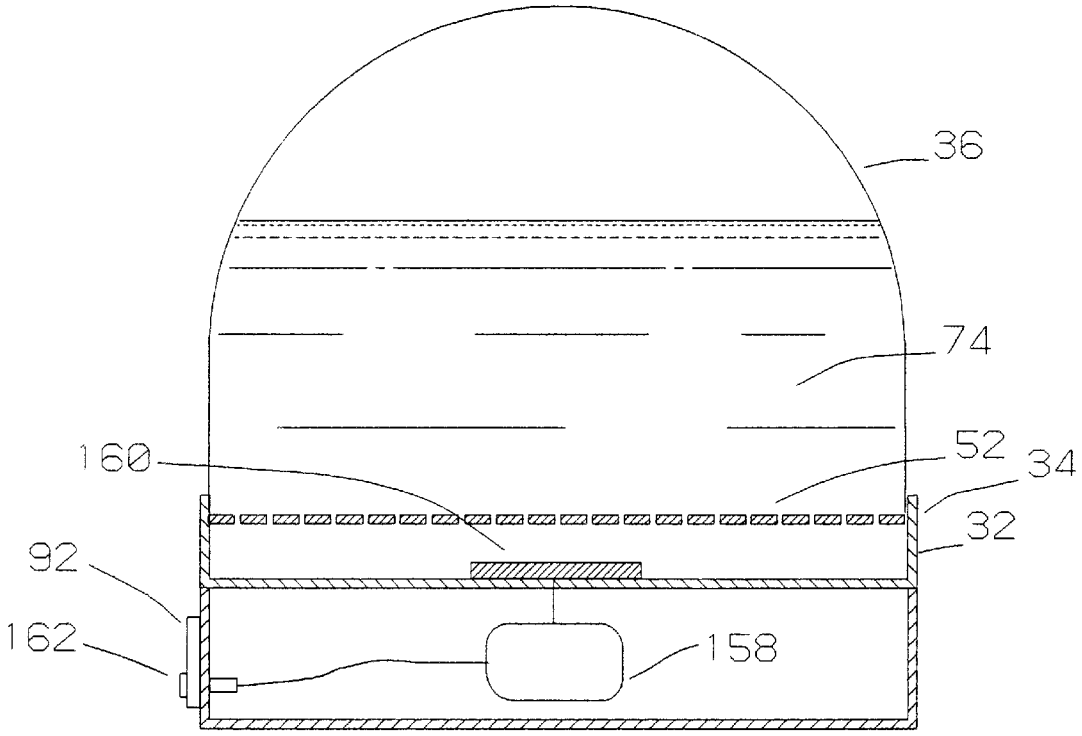

FIG. 7*g* illustrates the sonic vibration method of inducing action. Action is induced in water 74 inside bag 36 by means of inducing sonic vibrations resulting in cavitation, a very effective means of cleaning. An underwater speaker 160 is mounted inside water container 34 portion of housing 32. Speaker 160 is electrically driven by a sound generator/power amplifier 158. Optionally, music or other sound from a conventional external source such as a portable or home stereo (not shown) may be plugged into an input jack 162 on control panel connected to amplifier 158. When the external source produces music, then music is the waveform of the sonic vibration which produces the cleaning action, and the pleasant sound of music will emanate from the washing machine.

FIG. 8 illustrates a combination of multiple methods of inducing agitation combined in a single embodiment. The water jet method action is induced in water 74 inside bag 36 by means of water jets 54*a* and 54*b* through which water is forced by water pump 38 as is shown in FIG. 7*a*. Or, optionally, by operator selection on control panel 92, the water jet plus air bubbles action is induced in water 74 inside bag 36 by means of water jets 54*a* and 54*b* through which water and air are forced by water pump 38 and air pump 40 as shown in FIG. 7*b*. Additionally, in the same embodiment, as shown in FIG. 7*g*, sonic or ultrasonic vibration action is induced in water 74 inside bag 36 by use of an underwater transducer 164 mounted inside water container 34 portion of housing 32. Transducer 164 is electrically driven by a waveform generator/power amplifier 166. Optionally, music or other sound from a conventional external source such as a portable or home stereo (not shown) may be plugged into an input jack 162 connected to amplifier 166. This combination results in increased cleaning efficiency due to combined action of low frequency sloshing and high frequency vibration agitation.

FIGS. 9*a* to 9*e* show various views illustrating the detail of several implementations of conventional water treating devices, the inclusion of which is an object of an automatic washing machine according to the present invention.

Figure 9A:
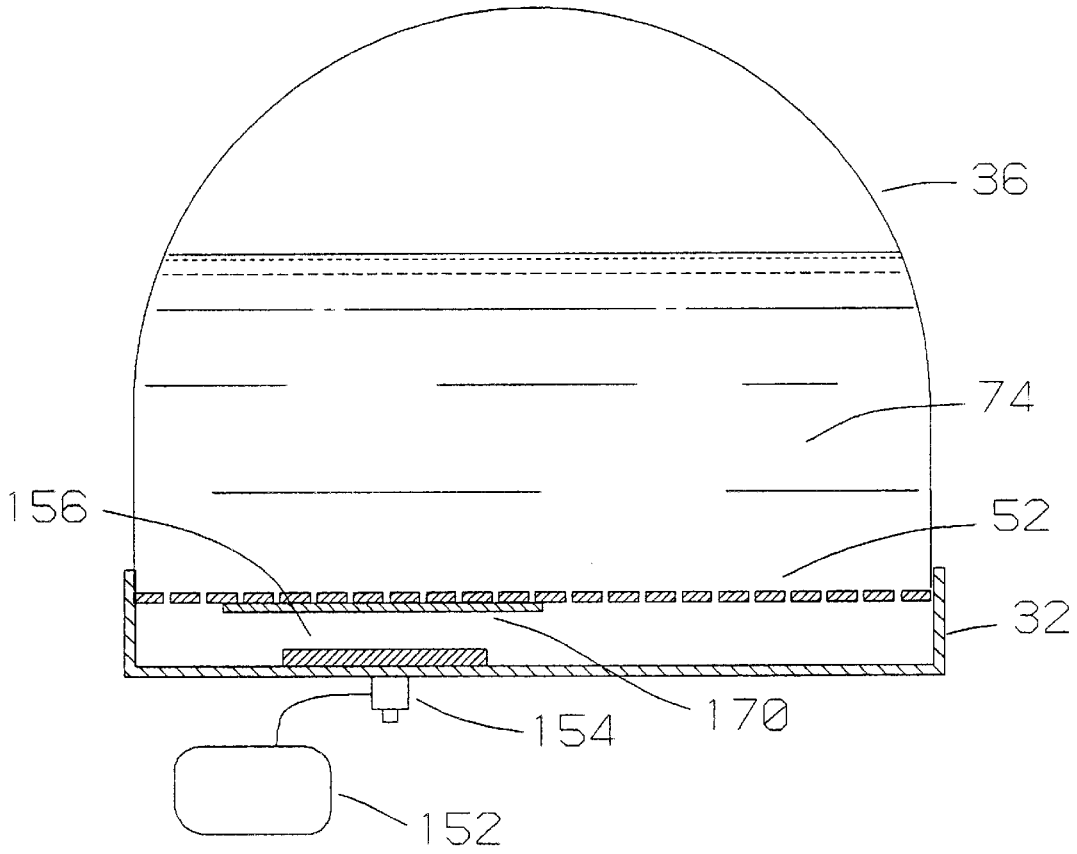

FIG. 9*a* shows a built in water treatment device wherein water 74 interacts with an electrically polarized material 170 to cause electrolysis of water 74. It has been empirically verified that electrolysis of water 74 has an effect on water 74 which is apparent softening without removing any of the dissolved solids. It has been hypothesized by those versed in the art, that electrolysis generates hydroxyl ions causing a surface active effect, thereby lowering the surface tension of water 74. This interaction is enhanced by agitation of water 74 in the vicinity of polarized material 170 by ultrasonic vibration plate 156. An example of electrically polarized material 170 is tourmaline in the form of a tourmaline ceramic coating. Some artificial materials such as some plastics also exhibit this electrically polarized property. In this embodiment, material 170 is a tourmaline ceramic coating on the bottom side of screen 52.

Water treatment by interaction with an electrically polarized material such as tourmaline is well known by those versed in the art and is adequately described in U.S. Pat. No. 5,309,739 to Lee (1994). Lee describes a device which utilizes the generation of surface-tension-reducing hydroxyl ions for the purpose of reducing the amount of detergent required, and explains the hypothesis behind the effect. That explanation is included herein by reference.

Figure 9B:
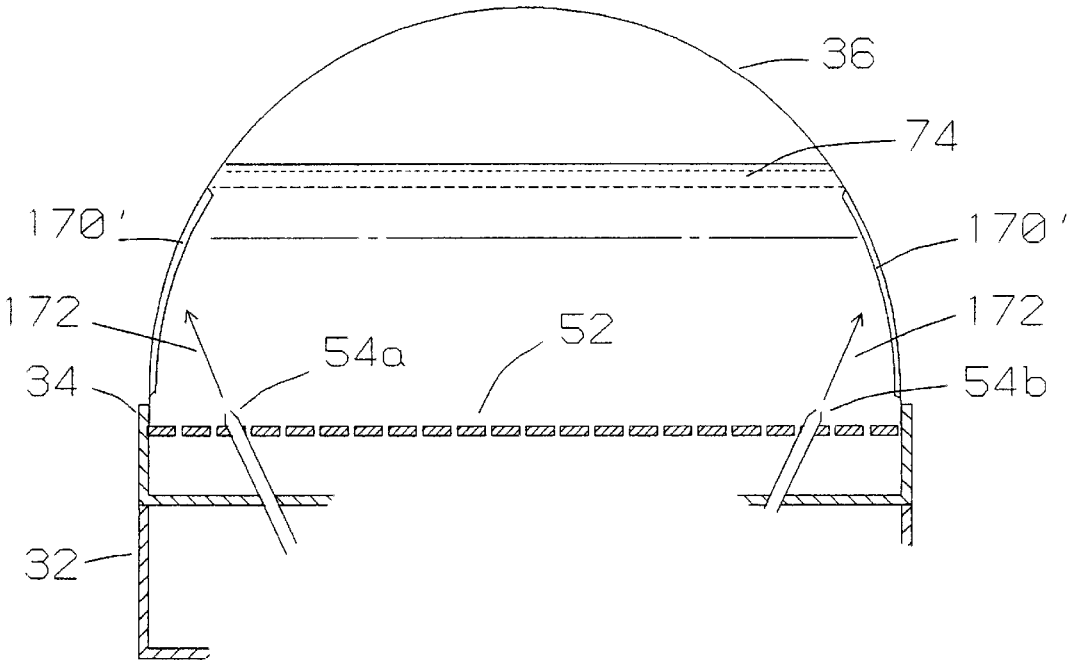

FIG. 9*b* shows a built in water treatment device wherein water 74 interacts with an electrically polarized material 170' to cause electrolysis of water 74. It has been empirically verified that electrolysis of water 74 has an effect on water 74 which is apparent softening without removing any of the dissolved solids. It has been hypothesized by those versed in the art, that electrolysis generates hydroxyl ions causing a surface active effect, thereby lowering the surface tension of water 74. This interaction is enhanced by agitation of water 74 in the vicinity of polarized material 170', by water jet 54*a* and 54*b* causing a water flow 172 directed against material 170'. In this embodiment, material 170' is an electrically polarized plastic coating on the inside of bag 36, which becomes more electrically polarized due to the friction of water flow 172 against polarized material 170'.

Figure 9C:
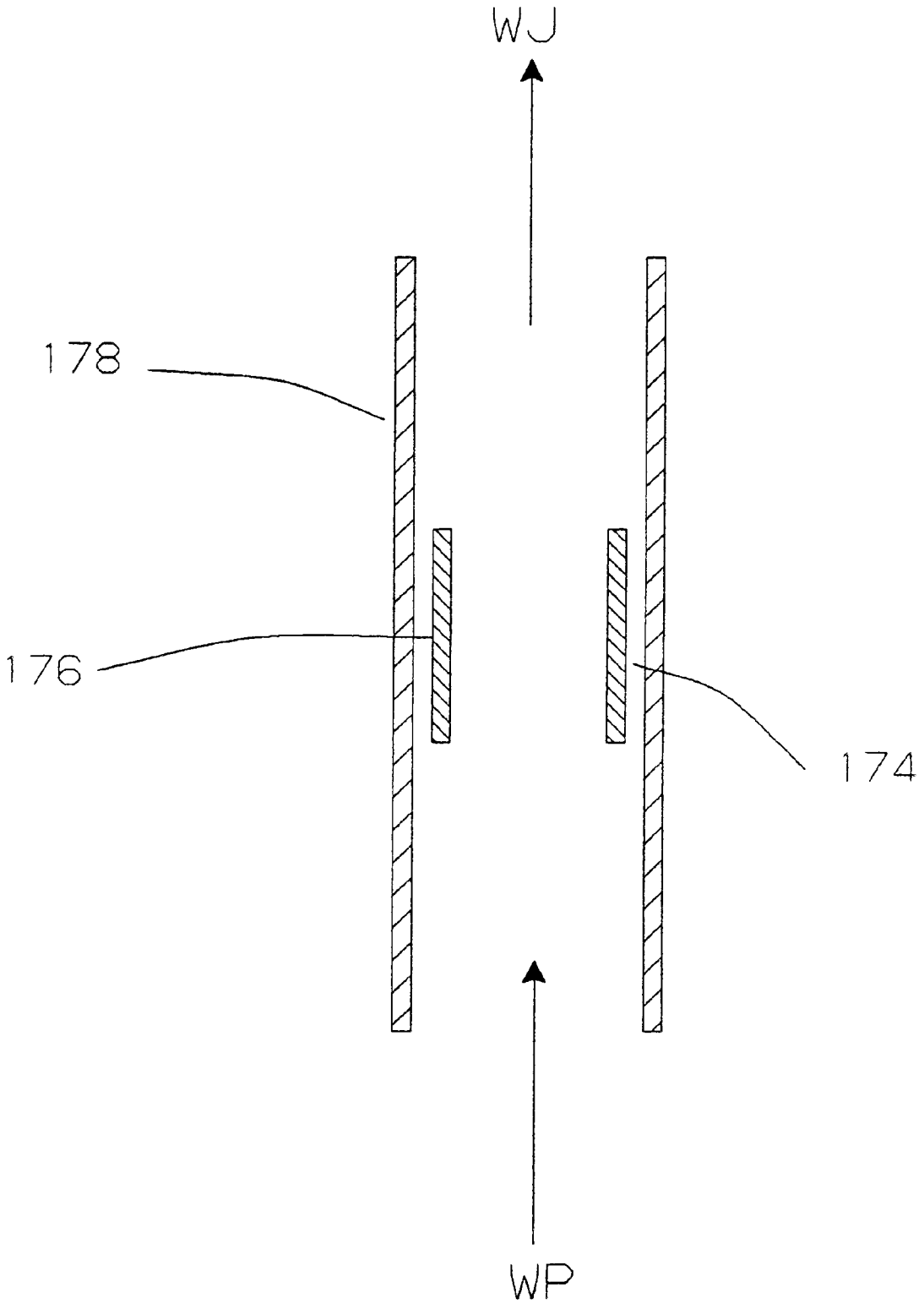

FIG. 9*c* shows a built in water treatment device wherein water 74 interacts with an electrode 174 and an electrode 176 which are electrically isolated electrodes of different electrochemical potential resulting in electrolysis of water 74. It has been empirically verified that electrolysis of water 74 has an effect on water 74 which is apparent softening without removing any of the dissolved solids. It has been hypothesized by those versed in the art, that electrolysis generates hydroxyl ions causing a surface active effect, thereby lowering the surface tension of water 74. This interaction is enhanced by flow of water 74 in the vicinity of electrodes 174 and 176. By locating electrodes 174 and 176 inside a section of pipe 178 containing water 74 as water 74 is circulated during agitation. In this embodiment, electrode 174 is made of a material containing aluminum and electrode is 176 is made of a material containing carbon. Other electrically conductive materials having different electrochemical potentials may be used.

Water treatment by interaction with electrically isolated electrodes of different electrochemical potential is well known by those versed in the art and is adequately described in U.S. Pat. No. 5,358,617 to Ibbott (1994). Ibbott describes a device which utilizes electrically isolated electrodes of different electrochemical potential to ionize the wash water inside a prior art washing machine for the purpose of reducing the amount of detergent required. That explanation is included herein by reference.

Figure 9D:
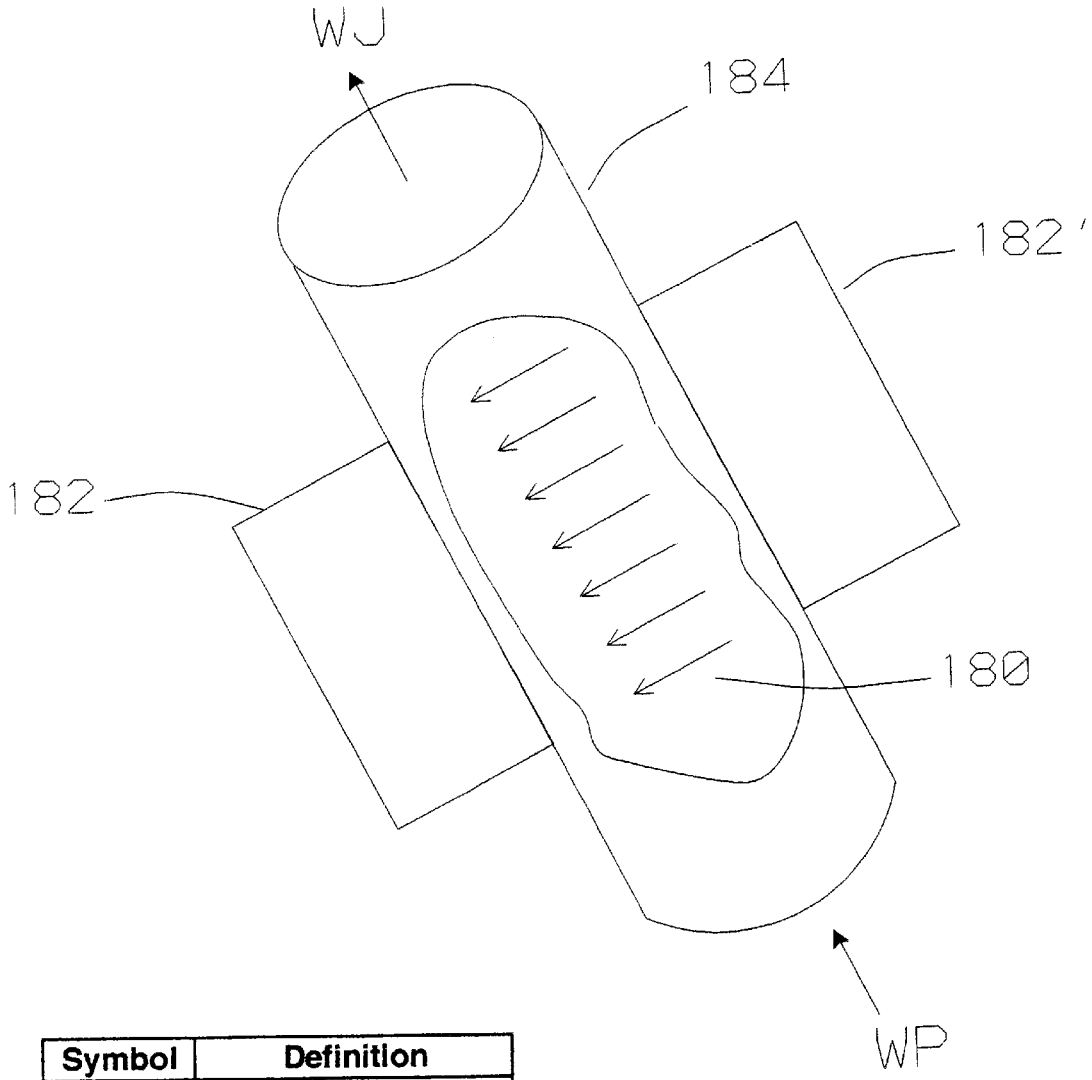

FIG. 9*d* shows a built in water treatment device wherein water 74 interacts with a magnetic field. It has been empirically verified that passing water 74 through a magnetic field 180 causes the deposition of lime scale to cease, and accumulated lime scale to decrease. This is an effect akin to softening of water without physically removing the dissolved metal ions from water 74. It is well known to those versed in the art that this phenomenon has an effect of reducing the amount of detergent necessary to clean clothes. In this embodiment a magnet 182 is placed on one side of a section of pipe 184 and a magnet 182' is placed on the opposite side of pipe 184 causing magnetic field 180 to occur inside pipe 184.

Figure 9E:
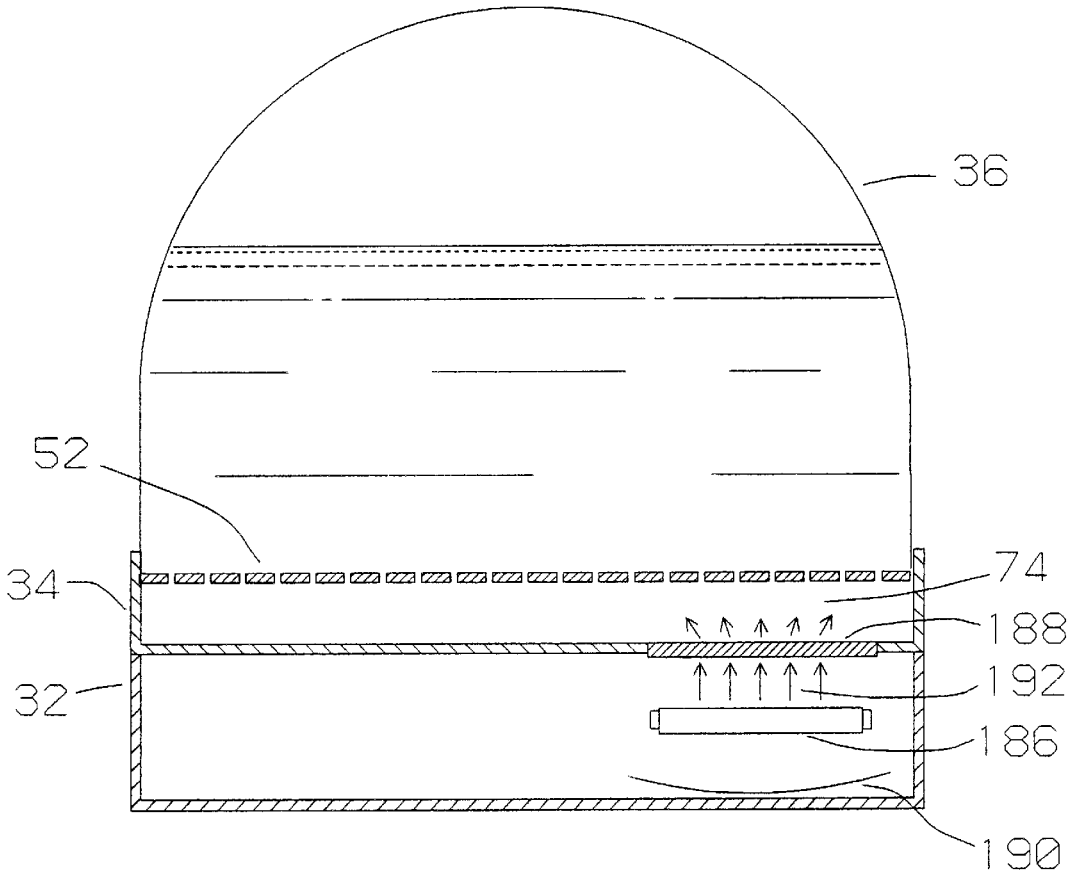

FIG. 9*e* shows a built in water treatment device wherein water 74 is exposed to ultra violet radiation. It has been empirically verified that exposing laundry water 74 to ultra violet radiation kills bacteria in water 74. An ultra violet light 186 is installed inside base 32 such that ultra violet light passes through an ultra violet light window 188 into the lower portion of water container 34, exposing water 74 to an ultra violet radiation 192. An ultra violet reflector 190 is installed behind ultra violet light 186 to reflect ultra violet radiation 192 into water 74.

Figure 10A:
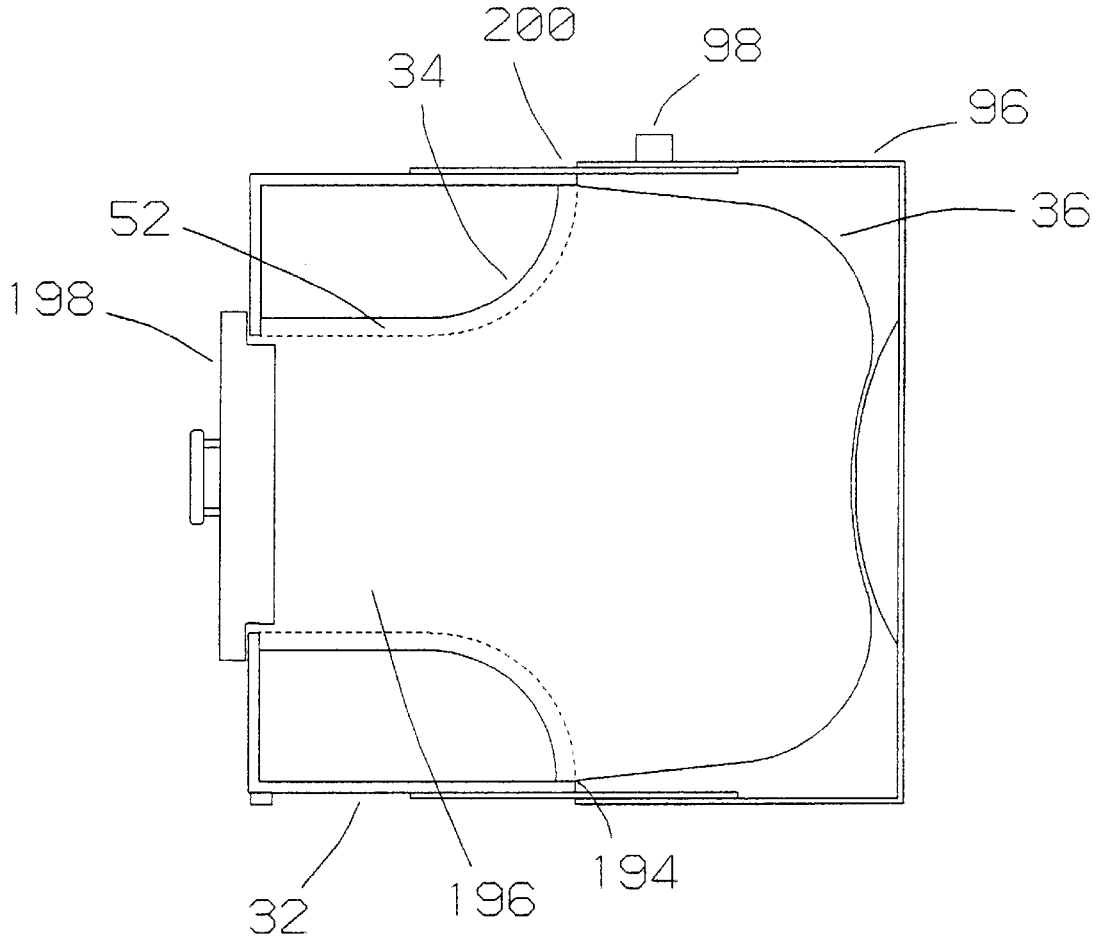
Figure 10B:
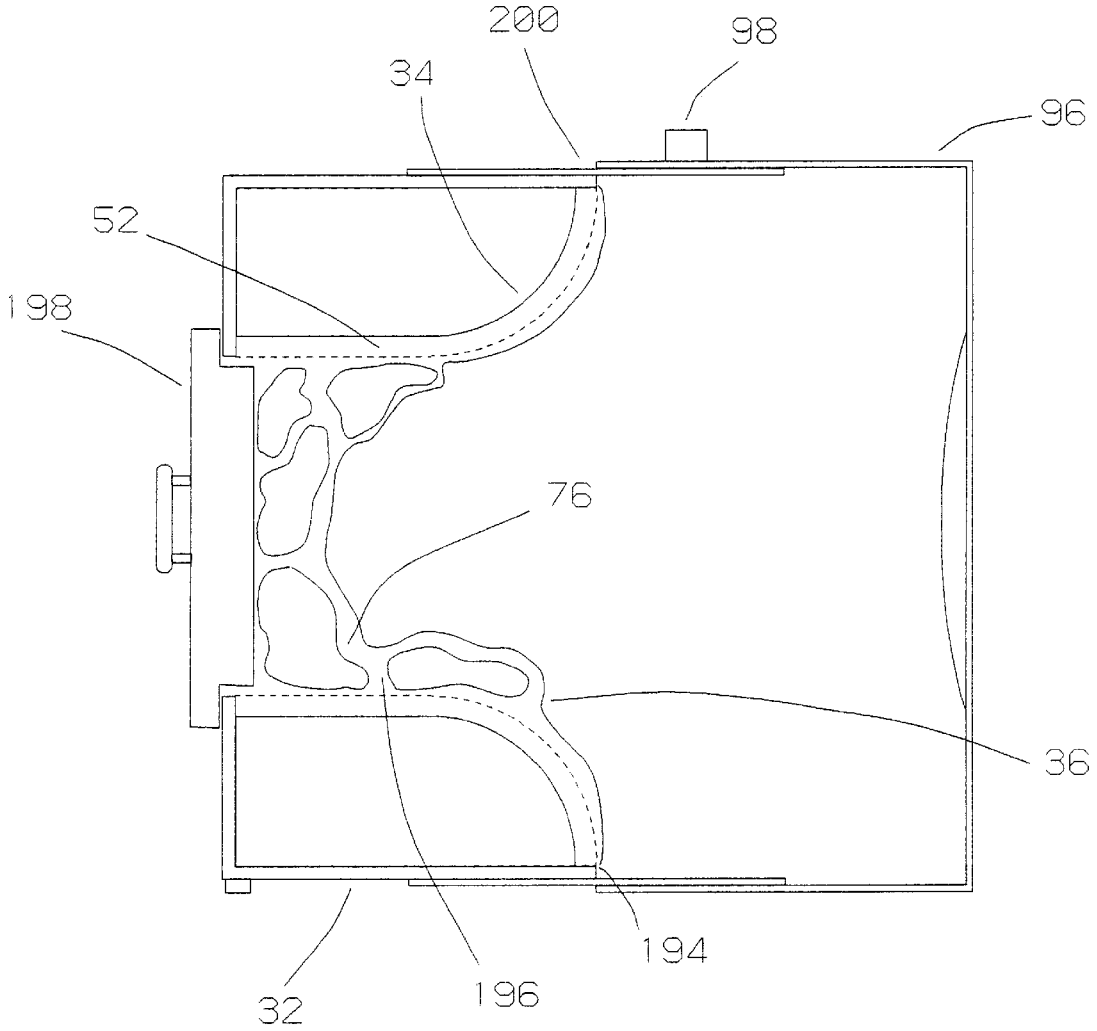
Figure 10C:
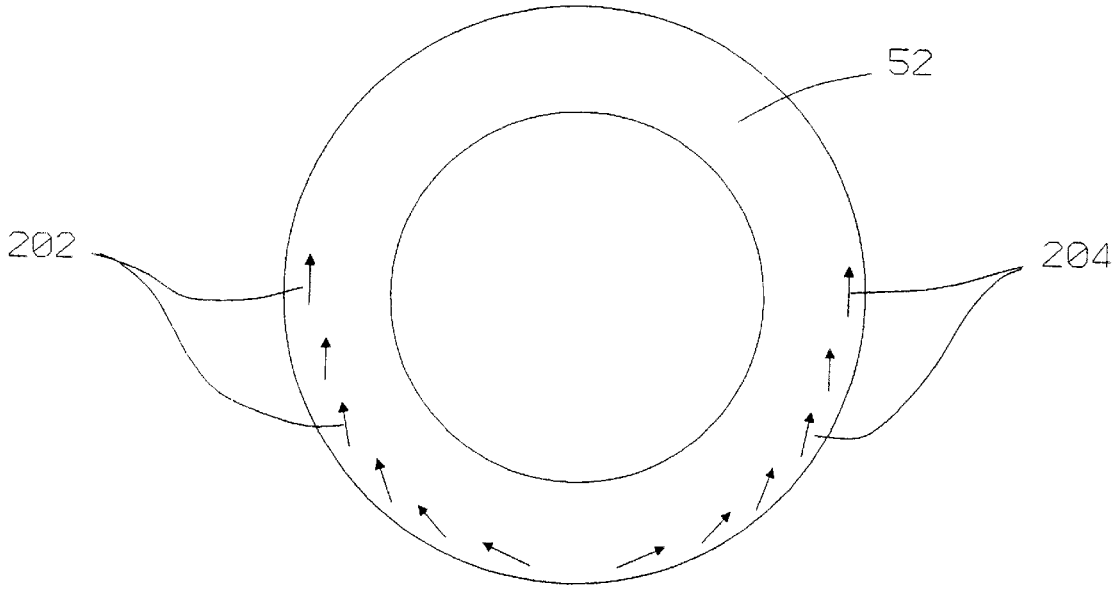
Figure 10D:
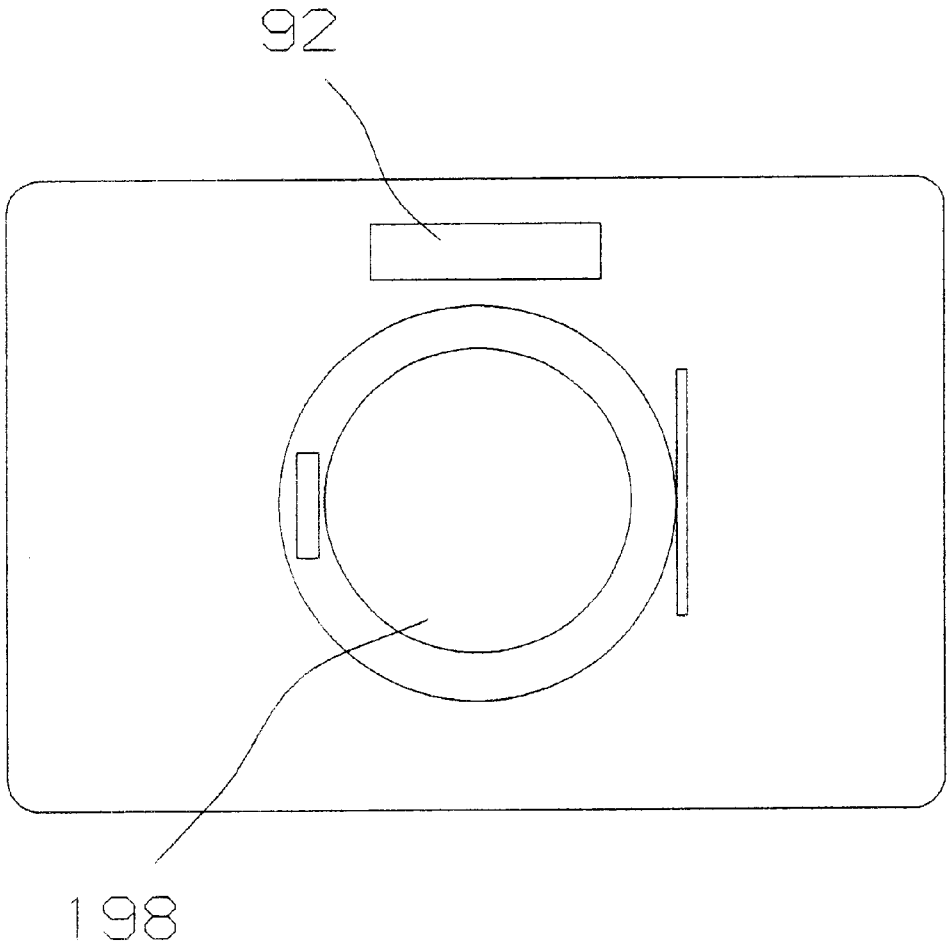

FIGS. 10*a* to 10*d* illustrate an alternate preferred embodiment of the automatic washing machine of the present invention. FIG. 10*a* is a side section view with bag 36 expanded for operation. FIG. 10*b* is the same side section view with bag 36 collapsed during the water extraction operation. FIG. 10*c* is a rear view of screen 52 showing water jet arrangement. FIG. 10*d* is a front view. This alternate preferred embodiment is very similar to the wall mounted embodiment illustrated in FIGS. 5*a* to 5*c* with the exception that housing 32, is in the form of a yoke, similar to a donut, around a neck 196 of container 34, container 34 being made up of bag 36 connected to housing 32 at connecting point 194. In this arrangement the various components in housing 32 are arranged around neck 196 of container 34. Screen 52 is a ring around neck 196 of container 34, curved around housing 32 in a conformable way, spaced a predetermined distance away from housing 32 to provide space for water to flow between screen 52 and housing 32. With this arrangement, a see through door 198, permitting a view of the inside of the machine while in operation, is fitted on the opposite side of housing 32 from bag 36. Articles 76 enter container 34 by passing through neck 196 of container 34. The embodiment shown here is built into a telescoping suitcase 200. The side of the suitcase with the door is the front of the machine and appears to the operator very similar to a conventional front loading washing machine of the prior art. The back of the suitcase telescopes out to make room for bag 36 to expand while in use. In the particular embodiment shown, a left set of water jets 202, in a manner explained for water jet 54*a* of FIG. 7*a* causes agitation in a clockwise direction. A right set of waterjets 204, in a manner explained for to water jet 54*b* of FIG. 7*a* causes agitation in a counterclockwise direction. Water treatment features (not shown) and other means of agitation, either singly or in combination (not shown) are optional features on this embodiment as well as on the others. This embodiment also, is optionally fitted with a flange to be built into a wall similar to the embodiment in FIGS. 5*a* to 5*c*.

FIG. 11 applies to any of the many embodiments of the inventive automatic washing machine. In FIG. 11 a functional block diagram of the inventive washing method 206 illustrates the overall concepts behind the devices and methods which make up the inventive automatic washing machine, and their usage. Diagram 206 illustrates the process flow of the inventive method of washing clothes. Diagram 206 is to aid in the following explanation of the usage of the inventive automatic washing machine. The accompanying explanation refers to parts shown in the other figures above.

A block labeled controller 226 represents the function of controlling device 42 in FIG. 2 and other Figs. Control of the process is automatically accomplished from a step c 212 through a step g 220. Steps before and after are under the control of the operator.

A step a 208 is set up machine. Setting up the machine, is accomplished differently depending on the embodiment. Basically the machine is removed from storage, opened if necessary, and connected to water, drain, and power.

Some embodiments are stored in a shape resembling a suitcase. The suitcase is carried from storage, opened, and the connections made as described in the explanation for FIG. 3.

On some models, the water temperature is adjusted at tap 86 of FIG. 3.

With the wall mounted embodiment, the water, drain, and power is permanently connected, thus simplifying set up. On this model, the backboard 104 in FIG. 5 is simply unclasped and lowered to complete the set up.

A step b 210 is load and select cycle. Loading the machine and selecting the cycle is accomplished very similar to performing the same function with a conventional automatic washing machine of the prior art. The machine is opened, dirty clothes are put in along with optional laundry products such as detergent, and the machine closed. On control panel 92 (shown in FIGS. 4 and 5), the desired cycle pattern is selected, and the power turned on. Control is thereby transferred to controlling device 42.

A step c 212 is fill with water. Filling the machine with water under the control of controlling device 42 has several unobvious features.

First a leak test is done. As with water beds, when they were first introduced to the consumer, they met with consumer skepticism. There was fear of water spilling all over the house. The same skepticism is anticipated with the washing bag 36. To overcome this skepticism, the consumer can be assured that a test is performed to check for leaks before filling the machine with water. Such a test is to inflate bag 36 with air to a predetermined pressure, and wait to see if the pressure drops below a predetermined pressure, indicating a leak. If a leak is detected, operation is suspended and controller 42 notifies the operator.

Tip over detection is accomplished. Since most embodiments are portable, and may be tipped over, a conventional tip over detector (not shown) is checked by the controller before each filling. A tip over condition could disrupt the fill level sensor and result in excessive filling. If a tip over is detected, operation is suspended and controller 42 notifies the operator.

Fill to predetermined level is accomplished by using a conventional fill detector/sensor (not shown). Various type devices may be used depending on the embodiment. For the vertical embodiments a conventional water pressure sensing device may be used. In the horizontal embodiments a conventional float level detector may be used.

In an embodiment, as in prior art machines, a conventional device (not shown) is provided internal to the washing machine for mixing hot and cold water to achieve the desired water temperature. In another embodiment, as in prior art machines, a means for controlling the water temperature is external in the form of a mixing faucet which supplies the water pre-mixed to the desired temperature. In this case this function is performed manually in step a 208, above.

A step d 214 is wash. Washing action, is initiated after filling in step c 212. Washing action occurs in various ways in different embodiments as illustrated in FIGS. 7*a* to 7*g*. Simultaneously, any water treatment device as illustrated in FIG. 9 in the particular embodiment is activated. This is a very complex step and is described in detail in FIGS. 7*a* to 9*e*.

A step e 216 is extract water. Water extraction, is fully illustrated and described in FIGS. 6*a* to 6*d*.

A step f 218 is fill, rinse, extract. This step 218, is a predetermined number of repeats of step c 212, fill with water, step d 214,wash, and step e 216, extract water. Washing action is the same in the wash and the rinse cycles with the exception that any detergent added near the beginning in step b 210, is rinsed away in the rinse cycles. However, cleaning action continues in the rinse cycles because of the water treatment features built into the machine. The number of repeats of the filling, washing action, and water extraction processes is predetermined, depending on the particular cycle pattern selected on the control panel in step b 210. The number of repeats of the water extraction process within each repeat of the water extraction step is predetermined, depending on the particular cycle pattern selected on the control panel in step b 210, and whether the next step is another rinse or removal in step h 222.

A step g 220 is notify operator. Notification of the operator, is accomplished in the conventional way as in the prior art. It may be by a signal sound, or light, or both. Additionally any malfunctions such as a bag leak would result in some conventional signal appearing on the control panel.

A step h 222 is remove clean items. Removal of clean items, is accomplished in the way familiar to operators of the prior art machines. Simply open the machine and take out the clothes.

A step i 224 is store machine. Putting the machine into storage, is the reverse process of step a 208. If the embodiment is the wall mounted model, simply raise the backboard to the wall in the other room and secure the clasp. If the embodiment is one of the suitcase models, simply turn off the water and remove the quick disconnect hoses, and power cord. Coil them and place them in the lid. Close the lid. Pick up suitcase and carry it into storage.

In Summary

When it is desired to wash clothes, the machine is removed from it's storage space such as a closet or shelf, and carried to a location in proximity to an electrical outlet and a water tap which has previously been fitted with a quick disconnect water connector. The water inlet/outlet hose assembly of the machine is pulled out of it's storage location of the washing machine and connected to the water tap. The electric supply cord is connected to any electrical outlet. The machine bag is opened and the dirty clothes are put into the machine along with any desired laundry product. The machine is closed. The machine cycle selector is set to the desired automatic cycle, and turned on. The machine automatically goes through the selected cycle and turns off. The machine is opened and the clean clothes are removed. The hoses and power cord are disconnected from the supply and placed into their respective storage locations in the machine. The machine is then carried back to it's storage space out of the way.

When the machine is manually switched on the controlling device 42 causes various functions of filling, agitating, and extraction to occur. At the proper predetermined time the water fills the bag to a predetermined level. Once the predetermined level is reached, a means for agitation is turned on for a predetermined length of time. When the predetermined length of time is expired, the water extraction function is turned on for a predetermined time interval. This cycle is repeated a predetermined number of times and a predetermined duration of each time to wash and rinse the clothes and leave the clothes with the water extracted and ready to be dried.

Within each of the functions of agitation and extraction, the sub functions are controlled by the control means.

Conclusions, Ramifications, and Scope

Accordingly, the reader will see that the automatic washing machine of this invention is made possible without the two tubs, an agitator, and a metal enclosure required by the prior art. Yet, all the features of the prior art are included in the present invention. Beyond the features of the prior art, are several advantages of the present invention. Living space in the home is increased as there is no need for dedication of a room of the house for a wash machine. Homes without dedicated space can have the full capability of a laundry facility in the home. The gentle yet effective washing action saves wear and tear on clothes. The gentle yet effective water extraction method saves wear and tear on clothes. The water treatment methods employed increase the efficiency and reduce the amount of detergent necessary, and therefore reduce pollution of the environment.

The present invention employs a flexible bag and light plastic parts to eliminate the need for those heavy metal parts. The washing action is achieved by water movement interacting with the flexible bag and other plastic parts. The water movement is a pulsating action within the water achieved by pumping, by vibrating or by shaking in or about some part of the bag with the water transmitting the action through the clothes. This not only forces the water through the clothes, but also causes the clothes to rub against each other and the bag. Thus the dirt is loosened and rinsed away.

Surprisingly, the rubbing between the water and the electrically polarized dielectric surface of the plastic parts or flexible bag causes a surprising increase in the washing efficiency due to the generation of ionic action in the water. Further improvement in the cleaning properties of water is accomplished by optional magnetic treatment of the water. A vacuum apparatus is used to extract liquid and air from the bag and the bag thus collapses by atmospheric pressure squeezing the clothes forcing the water out. Repeated cycles of air vacuum out of the bag, and air pressure into the bag will extract more water and fluff the clothes to result in clothes dry enough to put in a clothes dryer or to hang on hangers for final drying. Means to fill and empty the bag with water and means to control the various cycles which are obvious to those versed in the art will complete an automatic washing machine. By virtue of a collapsible bag, and the unobvious benefits it enables, an entire, normal capacity washing machine is reduced into a volume that is suitable to be stored in an out of the way place when not in use. Elimination of the heavy metal parts of the currently popular conventional automatic washing machine of the prior art results in an automatic washing machine that is light enough to be lifted by one hand and carried into storage.

Unlike many other attempts to fill the need for a space saving appliance, this invention operates in the manner to which the homemaker is already accustomed, and little, if any, instruction is needed.

This invention will fill that long recognized and unfilled need for full sized automatic laundry capability in the home without the requirement for space normally dedicated to laundry machines. The automatic washing machine of the present invention has a capacity comparable to a standard automatic washing machine without the disadvantages associated with the space and weight requirements of a standard automatic washing machine according to the prior art. This machine has broken through two major barriers in this area, size and weight. The size of a standard washing machine is over come by the machine of this invention using smaller parts and also by being collapsible. In this invention, the weight of the standard washing machine is overcome not only by the use of lighter materials, but by an unexpected efficiency of the flexible tub washing method which results in a much more energy efficient agitating system. This energy efficiency results in supporting hardware being light enough to be easily carried manually. Using a flexible bag instead of a steel tub, the flexible bag and it's contents can be set in motion at any one area and the motion is transmitted throughout the entire bag by the inter-reaction of the water, the items being washed, and the flexible bag. This eliminates an energy wasting need for an agitator to drag the clothes back and forth.

This flexible bag has another unexpected advantage in that in the pumping out of the water with a vacuum pump, the bag collapses and actually wrings the water out by transmitting the outside atmospheric pressure to the clothes. The previous need for the water to be either wrung out by passing the clothes through rollers, or extracted by the centrifugal force of spinning has been eliminated.

The invention has uses beyond normal home laundry. Dry cleaning, car parts washing, farm produce washing, separation of clay from gold in a mining operation are but a few of the obvious uses.

Many obvious modifications come to mind that have not been included above. Examples of such things that anyone versed in the art would assume to be obvious are:

- The size is not limited to that of the standard household washing machine. A much larger or smaller version is obviously within the scope of the invention.
- Substitution of various assemblies for individual components, or the addition or deletion of check valves in place of controlled valves are but a few among many of the various options.
- Cleaning fluid or other washing solution could be used instead of water.
- Water treatment device may be in line, cartridge, or designed into the structure of the apparatus. Water treatment device may be built in or may be a replaceable cartridge. Water treatment device may be an option depending on water condition in users area.
- The washing container does not have to be round. It may be oval or some other shape. It may have a rigid side and be only partially collapsible.
- The screen does not have to be flat. It could be curved. Many parts that have been shown flat could be curved. Corners could be rounded. The base housing could be smaller than the bag.
- The air pump and the vacuum pump may be designed into a single unit using a single motor. The motor may be multi speed, depending on the load, whether it is water or air. The pump unit may even be in combination with control valves.

The closure means of the top opening bag need not be a drawstring. It can be other means such as a water proof zipper, a clamp, or other conventional closing device.

Some embodiments could even be operated in case of a lack of power. the bag could be loaded, massaged by hand or foot, then the clothing removed and hand wrung.

In an alternate design for a horizontal embodiment, the suitcase lid can be the horizontal surface with the hinge on the back (bottom) and the clasp on the top near the handle. The suitcase can be opened in a standing position and the lid lay back on the floor with the bag falling into the lid. The bag and bag holder is then opened away from the housing for clothes to be inserted or removed.

The hoses and power cord can be stored in the lid when not in use.

On models that open other than at the top of the bag, an interlock could be used as in conventional front loader machines, to prevent opening at the wrong time and spilling water.

While plastic has been described, a more rugged embodiment could have many parts made of metal.

The bag may be tapered so that with age, if it swells it will not become unstable.

Many items detailed above are optional, and can be omitted. Many can be changed in size, made of different material, made of a different shape, connected or associated in a different manner, made integrally or in sections, or varied in other ways without departing from the invention in its broader aspects. These items are offered by way of illustration only and not as a limitation.

Since the only difference between sonic and ultrasonic is the frequency range, the sonic and ultrasonic washing actions can be combined by the substitution of a wide range waveform generator/power amplifier instead of the ultrasonic generator and the sound generator/power amplifier, and substitution of a wide range underwater transducer instead of the underwater speaker and the ultrasonic vibrator and plate.

Several alternate scrubbing actions and means of generating those actions have been described. Others too numerous to include are obvious to one versed in the art. Other examples include a bag laying on motion device, rocking, kicking or shoving by any means, motion imparted from a vibrating object inside the bag, motion imparted from a vibrating device outside the bag, any alternating deformation of the bag, injection and extraction of fluid into and out from the bag, friction with sides, friction with items, circulating fluid inside the bag and circulating air bubbles within the fluid. A set of multiple agitating methods could be used simultaneously, or alternatingly.

Many variations on agitation have been presented. Many more are obvious to one versed in the art. A few examples will illustrate the variety. Where agitation is accomplished by reversing the flow of water in the bag, a reversible pump could be used for reversing the flow of water. Conventional automatically operated valves could be used for reversing the flow of water. A manifold with water jets in at least two directions could be used for reversing the flow of water. Each of the directions could be used independently.

Many variations on built in water treatment devices have been presented. Many more are obvious to one versed in the art. A few examples will illustrate the variety. An ion exchange water treating cartridge, could be installed for those with hard water. Rapid vibration of the fluid which results in cavitation, has been presented as a means of agitation. Others versed in the art might argue that it is a means of water treatment. Many physical phenomena result in the improvement of cleaning properties of water. The intent is to include as many as are obvious to one versed in the art. The inclusion of water treatment, whatever form it may take, is an object of the invention.

While particular embodiments of the present invention have been shown and described, it will be obvious to those skilled in the art that changes and modifications may be made without departing from the invention in its broader aspects. For example, where water is mentioned throughout the descriptions, it is obvious that any cleaning solution may be substituted, where textiles or clothes are mentioned throughout the descriptions, other objects could be washed including such diverse items as farm produce or the removal of clay from placer gold. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A light weight and portable washing apparatus, comprising:

(a) a support housing enclosing all mechanical/electrical components and having a support portion, (b) a container, at least partially constructed in a form of a flexible container, for containing a load of items to be washed and a fluid for dousing, said flexible container having a screen with said screen being directly supported by said support section, (c) a filling means for inserting said fluid into said container, (d) an agitating means for imparting washing action to said load of said container, wherein said fluid, said items to be washed and said flexible container all become part of said washing action, providing interaction between said flexible container and contents therein, resulting in improved cleaning properties of said washing action, and whereby said improved cleaning properties result in more efficient cleaning of said items.

2. Washing apparatus of claim 1 further comprising:

(a) an extracting means for extracting said fluid out from said load, (b) a controlling means for automatically controlling at least one means selected from the group consisting of, (a) said filling means, and (b) said agitating means, and (c) said extracting means, whereby said items will be automatically washed in said fluid inside said container by a combined action of said load, said fluid, and said flexible container in a sequence of automatically controlled events.

3. Washing apparatus of claim 2 wherein said washing apparatus is collapsible into a compact space for storage by virtue of said flexible container, resulting in a compactible automatic laundry washing machine.

4. Washing apparatus of claim 1 wherein said agitating means is at least one selected from the group consisting of, (a) a pumping means for pumping said fluid into and out of said container, and (b) a sequencing means for causing a fluid movement pattern to change with time, and (c) a reversible rotating means for imparting agitation to said load and said container, and (d) a low frequency vibrating means for imparting agitation to said load and said container, and (e) an ultrasonic vibrating means for causing ultrasonic waves to occur in said load of said container, and (f) a sound inducing means for causing sound frequency waves to occur in said load of said container, whereby agitation is induced in said fluid relative to said flexible container causing relative motion among said fluid, said items, and said flexible container causing cleaning of said items.

5. Washing apparatus of claim 1 wherein said washing fluid is at least part water and further comprising a water treating means, said water treating means being at least one means selected from the group consisting of, (a) ionic treating means for ionic water treatment, and (b) magnetic treating means for magnetic water treatment, and (c) electronic treating means for electronic water treatment, and (d) friction treating means for friction water treatment, and (e) cavitation treating means for cavitation water treatment, wherein said water treating means results in more efficient cleaning.

6. Washing apparatus of claim 1 wherein said agitating means is at least one selected from the group consisting of, (a) a pumping means for pumping said fluid into and out of said container, and (b) a sequencing means for causing a fluid movement pattern to change with time, and (c) a reversible rotating means for imparting agitation to said load and said container, and (d) a low frequency vibrating means for imparting agitation to said load and said container, and (e) an ultrasonic vibrating means for causing ultrasonic waves to occur in said load of said container, and (f) a sound inducing means for causing sound frequency waves to occur in said load of said container, whereby agitation is induced in said fluid relative to said flexible container causing friction between said fluid and said flexible container causing ion release into said fluid such that said fluid cleans more effectively.

7. Washing apparatus of claim 1 wherein said extracting means comprises:

(a) a vacuum producing means, and (b) said flexible container, wherein said flexible container is caused to collapse when vacuum is applied inside said container thereby transmitting atmospheric pressure to said load resulting in wringing said fluid from said load.

8. Washing apparatus of claim 7 wherein said extracting means further comprises:

(a) an air pressure producing means, and (b) an air pressure containing means, wherein said flexible container is caused to collapse when vacuum is applied inside said container thereby transmitting atmospheric pressure assisted by said air pressure to said load resulting in wringing said fluid from said load.

9. A method for washing items in a fluid inside a light weight and portable flexible container, said method comprising:

(a) providing a light weight and portable flexible container having a support housing enclosing all mechanical/electrical components and having a support portion, said flexible container having a screen with said screen being directly supported by said support section;

(b) placing said items to be washed into said flexible container;

(c) inserting a washing fluid into said flexible container;

(d) imparting a washing action to said washing fluid, to said items to be washed and to said flexible container, and wherein said washing fluid, said items to be washed and said flexible container all become part of said washing action, providing interaction between said flexible container and contents therein, resulting in improved cleaning properties of said washing action, and whereby said improved cleaning properties result in more efficient cleaning of said items.

10. The method of claim 9 further including:

(a) extracting fluid from said flexible container and said items to be washed, (b) providing an automatic controller which will control a plurality of steps, whereby said process for washing items in a fluid inside a flexible container is completed automatically.

11. The method of claim 9 wherein said washing action is a vibration of a sound wave form and of a sound frequency within a frequency range substantially from sub-sonic to ultra-sonic.

12. The method of claim 9 wherein said washing action is imparted to said container by an action on said container such action including squeezing, shaking, jiggling, and bumping.

13. The method of claim 9 wherein said washing action is imparted to said fluid inside said container by an action such as mechanically pumping said fluid in and out of said container.

14. The method of claim 9 wherein a composition of said washing fluid includes a fraction being a gas such as air.

15. The method of claim 9 wherein said washing fluid is predominately water.

16. The method of claim 15 further comprising:

a water treating process, whereby said water treating process causes increased efficacy of cleaning properties of water thereby resulting in more efficient cleaning.

17. The method of claim 16 that wherein said water treating process is at least one process selected from the group of processes comprising, (a) ionic water treating process, (b) magnetic water treating process, (c) electronic water treating process, (d) friction water treating process, (e) cavitation water treating process, whereby said water treating process causes increased efficacy of cleaning properties of water resulting in more efficient cleaning.

18. The method of claim 9 wherein said flexible container is sealable such that said washing fluid can be pumped out by vacuum extraction and said flexible container aids in said extraction process by squeezing said fluid out as said fluid is pumped out and atmospheric pressure compresses said flexible container.

19. The method of claim 18 wherein said atmospheric pressure is aided by additional air pressure.

20. The method of claim 18 wherein the composition of said washing fluid changes progressively from a liquid such as water to a gas such as air to facilitate in drying of said washed items by the mechanical and evaporative removal of said liquid.

* * * * *